US010857790B2

(12) United States Patent
Tonomura et al.

(10) Patent No.: US 10,857,790 B2
(45) Date of Patent: Dec. 8, 2020

(54) LIQUID DISCHARGE HEAD, LIQUID DISCHARGE APPARATUS, AND WIRING SUBSTRATE

(71) Applicant: Seiko Epson Corporation, Tokyo (JP)

(72) Inventors: Osamu Tonomura, Matsumoto (JP); Eiju Hirai, Azumino (JP); Motoki Takabe, Shiojiri (JP); Toru Kashimura, Shiojiri (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/443,937

(22) Filed: Jun. 18, 2019

(65) Prior Publication Data

US 2019/0381795 A1 Dec. 19, 2019

(30) Foreign Application Priority Data

Jun. 19, 2018 (JP) ..... 2018-115841

(51) Int. Cl.
*B41J 2/045* (2006.01)
*B41J 2/14* (2006.01)

(52) U.S. Cl.
CPC ..... *B41J 2/04581* (2013.01); *B41J 2/0457* (2013.01); *B41J 2/14072* (2013.01); *B41J 2/14201* (2013.01); *B41J 2/14233* (2013.01); *B41J 2002/14491* (2013.01)

(58) Field of Classification Search
CPC ..... B41J 2/14072
USPC ..... 347/50
See application file for complete search history.

(56) References Cited

U.S. PATENT DOCUMENTS

2001/0045967 A1* 11/2001 Hayasaki ..... B41J 2/04541 347/9
2006/0237229 A1* 10/2006 Sugahara ..... H01L 24/81 174/266
2012/0247816 A1* 10/2012 Koide ..... H05K 1/0268 174/254
2017/0210133 A1* 7/2017 Tsukahara ..... B41J 2/14233
2017/0266969 A1 9/2017 Kashimura
2018/0001637 A1* 1/2018 Fricke ..... B41J 2/14072

FOREIGN PATENT DOCUMENTS

JP 2017-164944 A 9/2017
JP 2017-164994 A 9/2017

* cited by examiner

*Primary Examiner* — Shelby L Fidler
(74) *Attorney, Agent, or Firm* — Harness, Dickey & Pierce, P.L.C.

(57) ABSTRACT

There is provided a liquid discharge head including a drive IC that outputs the first signal and the second signal, and a wiring substrate having a first side and a second side longer than the first side, electrically connected to the drive IC, and propagating the first signal and the second signal, in which the wiring substrate includes a first electrode to which the first signal is input, a second electrode to which the second signal is input, a third electrode electrically connected to the first electrode, and a fourth electrode electrically connected to the second electrode, and in a direction along the second side, the second electrode is positioned between the first electrode and the third electrode, and the third electrode is positioned between the second electrode and the fourth electrode.

9 Claims, 13 Drawing Sheets

LIQUID DISCHARGE HEAD, LIQUID DISCHARGE APPARATUS, AND WIRING SUBSTRATE

The present application is based on, and claims priority from, JP Application Serial Number 2018-115841, filed Jun. 19, 2018, the disclosure of which is hereby incorporated by reference herein in its entirety.

BACKGROUND

1. Technical Field

The present disclosure relates to a liquid discharge head, a liquid discharge apparatus, and a wiring substrate.

2. Related Art

A liquid discharge apparatus such as an ink jet printer discharges a liquid such as ink filled in a cavity from nozzles by driving a drive element such as a piezoelectric element provided in a liquid discharge head by a drive signal to form characters and images on a recording medium. In such a liquid discharge head, in order to miniaturize the liquid discharge head, a configuration, in which a drive IC outputting a drive signal input to the liquid discharge head, an interposer substrate, and an actuator substrate on which a drive element is provided, are electrically connected by bump electrodes, is known.

For example, JP-A-2017-164994 discloses an ink jet head (liquid discharge head) where an actuator substrate on which a piezoelectric element as a drive element is formed, an interposer substrate, and a drive IC that outputs a drive signal in which a piezoelectric element is driven, are electrically connected using bump electrodes.

A nozzle line is formed by forming a plurality of nozzles in one direction on the actuator substrate used for a liquid discharge head of a liquid discharge apparatus. Therefore, in the configuration in which the drive IC, the actuator substrate, and the interposer substrate described in JP-A-2017-164994 are electrically connected by the bump electrodes, when performing an inspection of a drive signal output from the drive IC, and propagated on the actuator substrate and the interposer substrate, a plurality of inspection terminals used for the inspection are provided in an end portion of the nozzle line in a direction in which the nozzle line is formed. As a result, there is a concern that variations may occur in a wiring length for propagating the drive signal to be inspected to the inspection terminal, and an inspection accuracy of the drive signal may be lowered.

SUMMARY

According to an aspect of the present disclosure, there is provided a liquid discharge head including a first drive element driven by a first signal supplied thereto, a second drive element driven by a second signal supplied thereto, a drive IC that outputs the first signal and the second signal, and a wiring substrate having a first side and a second side longer than the first side, electrically connected to the drive IC, and propagating the first signal and the second signal, in which the wiring substrate includes a first electrode to which the first signal is input, a second electrode to which the second signal is input, a third electrode electrically connected to the first electrode, and a fourth electrode electrically connected to the second electrode, and in a direction along the second side, the second electrode is positioned between the first electrode and the third electrode, and the third electrode is positioned between the second electrode and the fourth electrode.

In the liquid discharge head, a plurality of nozzles including a nozzle that discharges liquid by driving the first drive element may be arranged in the direction along the second side, and the first electrode, the second electrode, the third electrode, and the fourth electrode may be arranged in the direction along the second side.

In the liquid discharge head, the third electrode and the fourth electrode may be provided at positions not overlapping with the drive IC in a plan view of the wiring substrate.

In the liquid discharge head, a third signal that is a base of the first signal and the second signal may be input to the drive IC, the wiring substrate may include a fifth electrode that outputs the third signal to the drive IC, and a sixth electrode electrically connected to the fifth electrode, and a distance between the sixth electrode and the second side may be longer than a distance between the first electrode and the second side.

According to another aspect of the present disclosure, there is provided a liquid discharge apparatus including the aspect of the liquid discharge head and a control circuit that controls the liquid discharge head.

According to still another aspect of the present disclosure, there is provided a wiring substrate which is provided in a liquid discharge head including a first drive element driven by a first signal supplied thereto, a second drive element driven by a second signal supplied thereto, and a drive IC that outputs the first signal and the second signal, which has a first side and a second side longer than the first side, which is electrically connected to the drive IC, and which propagates the first signal and the second signal, the wiring substrate including a first electrode to which the first signal is input, a second electrode to which the second signal is input, a third electrode electrically connected to the first electrode, and a fourth electrode electricall connected to the second electrode, in which in a direction along the second side, the second electrode is positioned between the first electrode and the third electrode, and the third electrode is positioned between the second electrode and the fourth electrode.

DESCRIPTION OF EXEMPLARY EMBODIMENTS

Hereinafter, preferred embodiments of the present disclosure will be described with reference to the drawings. The drawings used are for convenience of explanation. Note that, the embodiments described below do not unreasonably limit the contents of the present disclosure described in the claims. In addition, all of the configurations described below are not necessarily indispensable constitutional requirements of the present disclosure.

Hereinafter, a liquid discharge head provided with a wiring substrate according to the present disclosure will be described by taking a liquid discharge head applied to a liquid discharge apparatus as a printing apparatus, as an example.

1 First Embodiment

1.1 Outline of Liquid Discharge Apparatus

Figure 1:
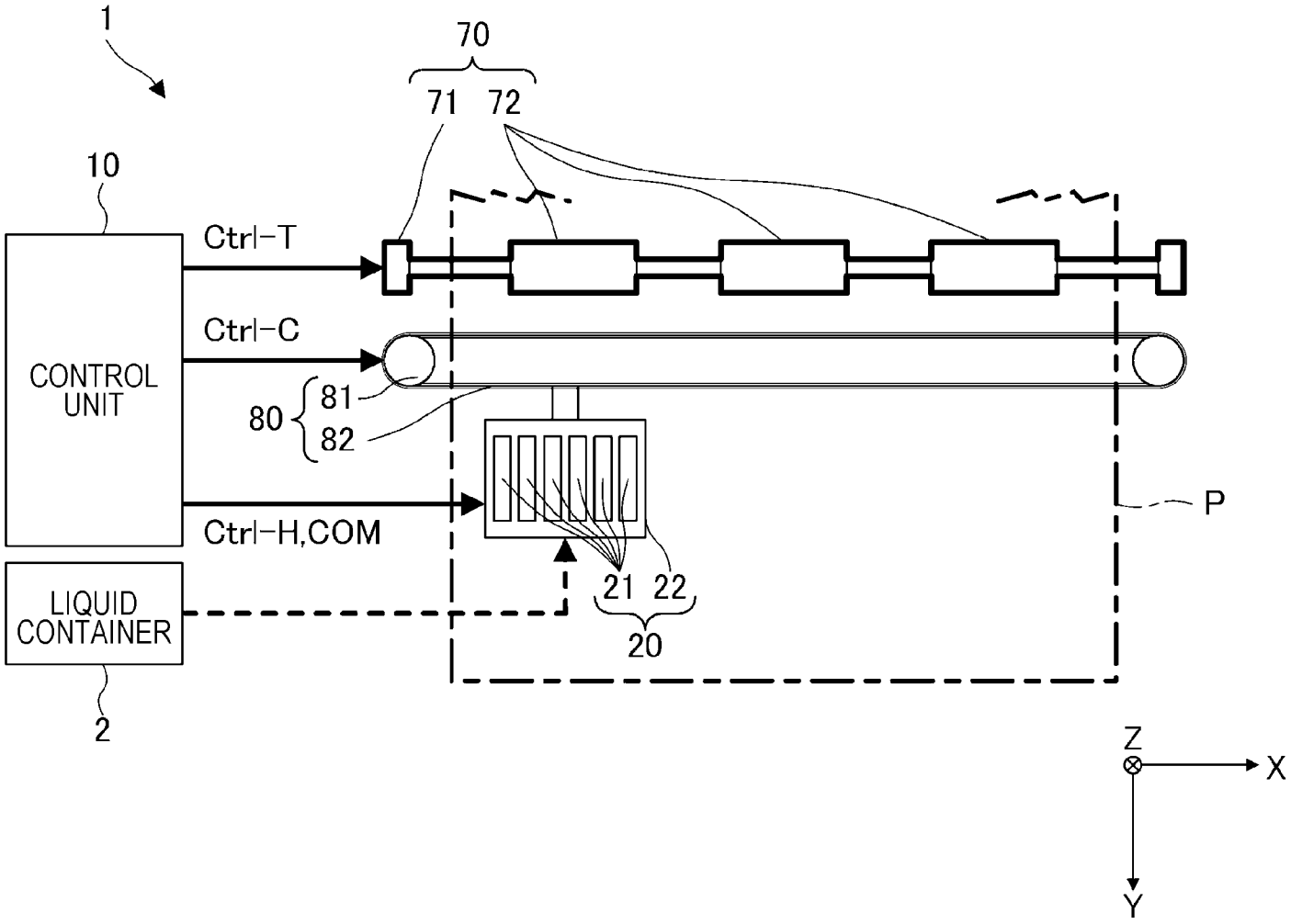
FIG. 1 is a diagram showing a schematic configuration of a liquid discharge apparatus.

FIG. 1 is a diagram showing a schematic configuration of a liquid discharge apparatus 1 to which a liquid discharge head of the present embodiment is applied. The liquid discharge apparatus 1 according to the present embodiment is a serial printing type ink jet printer where a carriage 22, on which liquid discharge heads 21 for discharging ink as an example of a liquid are mounted, reciprocates and ink is discharged onto a medium P to be transported. In the following description, it is assumed that an axis in which the carriage 22 moves is a X axis, a direction in which the medium P is transported is a Y direction, and a direction in which the ink is discharged is a Z direction. Note that in the following description, it is assumed that the X axis, the Y direction and the Z direction are orthogonal to each other. As the medium P, any printing target such as a printing paper, a resin film, and a cloth may be used.

The liquid discharge apparatus 1 includes a liquid container 2, a control unit 10, a head unit 20, a moving unit 80, and a transport unit 70.

In the liquid container 2, a plurality of kinds of inks to be discharged onto the medium P are stored. Specifically, six types of inks of black, cyan, magenta, yellow, red, and gray are stored in the liquid container 2. The number and types of inks stored in the liquid container 2 is merely an example, and the number of inks stored in the liquid container 2 may be five or less, or may be seven or more. Furthermore, inks of colors such as light cyan, light magenta, green may be stored in the liquid container 2. As the liquid container 2 in which such inks are stored, an ink cartridge, a bag-shaped ink pack formed of a flexible film, an ink tank capable of replenishing ink, or the like are used.

The control unit 10 includes a processing circuit such as a central processing unit (CPU), a field programmable gate array (FPGA), or the like and a memory circuit such as a semiconductor memory, and controls each element of the liquid discharge apparatus 1.

The head unit 20 includes the liquid discharge heads 21 and the carriage 22. The liquid discharge heads 21 are mounted on the carriage 22. The carriage 22 is fixed to an endless belt 82 included in the moving unit 80 in a state where the liquid discharge heads 21 are mounted. Note that the liquid container 2 may also be mounted on the carriage 22. Further, control signals Ctrl-H including a plurality of signals for controlling the liquid discharge heads 21 and one or a plurality of drive signals COM for driving the liquid discharge heads 21 are input from the control unit 10 to the liquid discharge heads 21. The liquid discharge heads 21 discharge ink supplied from the liquid container 2 in the Z direction based on the control signals Ctrl-H and one or more drive signals COM.

The moving unit 80 includes a carriage motor 81 and the endless belt 82. The carriage motor 81 operates based on a control signal Ctrl-C input from the control unit 10. The endless belt 82 pivots in accordance with an operation of the carriage motor 81. In this way, the carriage 22 fixed to the endless belt 82 reciprocates in the X axis.

The transport unit 70 includes a transport motor 71 and transport rollers 72. The transport motor 71 operates based on a control signal Ctrl-T input from the control unit 10. Then, the transport rollers 72 pivot according to an operation of the transport motor 71. The medium P is transported in the Y direction according to the pivot of the transport rollers 72.

As described above, the liquid discharge apparatus 1 causes ink to land at any position on a surface of the medium P to form a desired image on the medium P by discharging the ink from the liquid discharge heads 21 included in the head unit 20 in conjunction with the transport of the medium P by the transport unit 70 and the reciprocation of the head unit 20 by the moving unit 80 based on various signals output from the control unit 10.

1.2 Electrical Configuration of Liquid Discharge Apparatus

Figure 2:
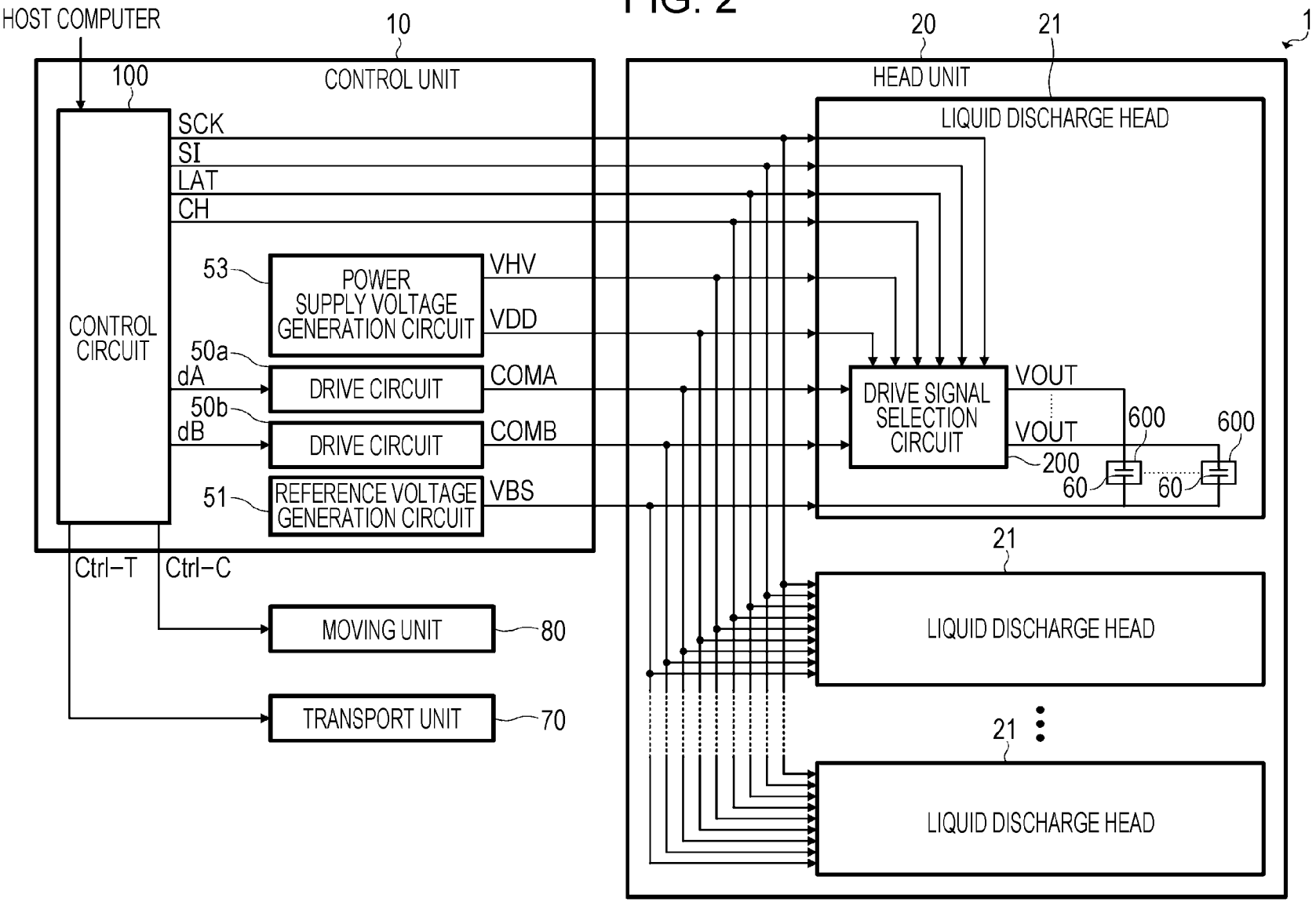
FIG. 2 is a block diagram showing an electrical configuration of the liquid discharge apparatus.

FIG. 2 is a block diagram showing an electrical configuration of the liquid discharge apparatus 1. The liquid discharge apparatus 1 includes the control unit 10, the head unit 20, the moving unit 80, and the transport unit 70. As shown in FIG. 2, the control unit 10 includes a control circuit 100, drive circuits 50*a* and 50*b*, a reference voltage generation circuit 51, and a power supply voltage generation circuit 53.

The control circuit 100 includes, for example, a processor such as a microcontroller. The control circuit 100 generates data or signals for controlling the liquid discharge apparatus 1 based on various signals such as image data supplied from a host computer.

Specifically, the control circuit 100 outputs the control signal Ctrl-C corresponding to a scanning position of the head unit 20 to the moving unit 80. Thus, the reciprocation of the head unit 20 is controlled. Further, the control circuit 100 outputs the control signal Ctrl-T to the transport unit 70. Consequently, the transportation of the medium P is controlled. Note that the control signal Ctrl-C may be supplied to the moving unit 80 after a signal conversion by a signal conversion circuit (not shown). Note that the control signal Ctrl-T may be supplied to the transport unit 70 after a signal conversion by the signal conversion circuit (not shown).

In addition, the control circuit 100 outputs a printing data signal SI, a change signal CH, a latch signal LAT, and a clock signal SCK as the control signal Ctrl-H for controlling the head unit 20 based on various signals such as image data supplied from the host computer.

Further, the control circuit 100 outputs drive control signals dA and dB which are digital signals of the drive circuits 50*a* and 50*b*, respectively.

Specifically, the drive control signal dA is input to the drive circuit 50*a*. The drive circuit 50*a* performs digital/analog conversion on the drive control signal dA, and then class-D amplifies the converted analog signal to generate the drive signal COMA. The drive circuit 50*a* outputs the generated drive signal COMA to the head unit 20. Further, the drive control signal dB is input to the drive circuit 50*b*. The drive circuit 50*b* performs digital/analog conversion on the drive control signal dB, and then class-D amplifies the converted analog signal to generate the drive signal COMB. The drive circuit 50*b* outputs the generated drive signal COMB to the head unit 20.

The reference voltage generation circuit 51 generates a reference voltage signal VBS supplied to piezoelectric elements 60 included in the head unit 20. The reference voltage signal VBS is, for example, a voltage signal of DC 6 V. Then, the reference voltage generation circuit 51 outputs the generated reference voltage signal VBS to the head unit 20. Note that the reference voltage generation circuit 51 may generate and output a voltage signal of a different voltage value other than DC 6 V such as a ground electric potential.

The power supply voltage generation circuit 53 generates a high voltage signal VHV and a low voltage signal VDD. The high voltage signal VHV is, for example, a voltage signal of DC 42 V. The low voltage signal VDD is, for example, a voltage signal of 3.3 V. Each of the high voltage signal VHV and the low voltage signal VDD is used as a power supply voltage of various configurations in the control unit 10 and is also output to the head unit 20. Note that the power supply voltage generation circuit 53 may generate various voltage signals other than the high voltage signal VHV and the low voltage signal VDD.

The head unit 20 includes a plurality of liquid discharge heads 21. The print data signal SI, the change signal CH, the latch signal LAT, the clock signal SCK, the drive signals COMA and COMB, the reference voltage signal VBS, the high voltage signal VHV and the low voltage signal VDD, which are input to the head unit 20, are branched in the head unit 20 and then supplied to each of the plurality of liquid discharge heads 21. Note that each of the plurality of liquid discharge heads 21 has the same configuration.

Each liquid discharge head 21 includes a drive signal selection circuit 200 and a plurality of discharge units 600. The drive signal selection circuit 200 generates drive signals VOUT by selecting or deselecting the drive signals COMA and COMB based on the input signals such as print data signal SI, the clock signal SCK, the latch signal LAT and the change signal CH. Then, the drive signal selection circuit 200 supplies the drive signal VOUT to the piezoelectric element 60 included in the corresponding discharge unit 600. The piezoelectric element 60 is displaced when the drive signal VOUT is supplied. Then the amount of ink according to the displacement is discharged from the discharge unit 600.

1.3 Configuration of Liquid Discharge Head

Figure 3:
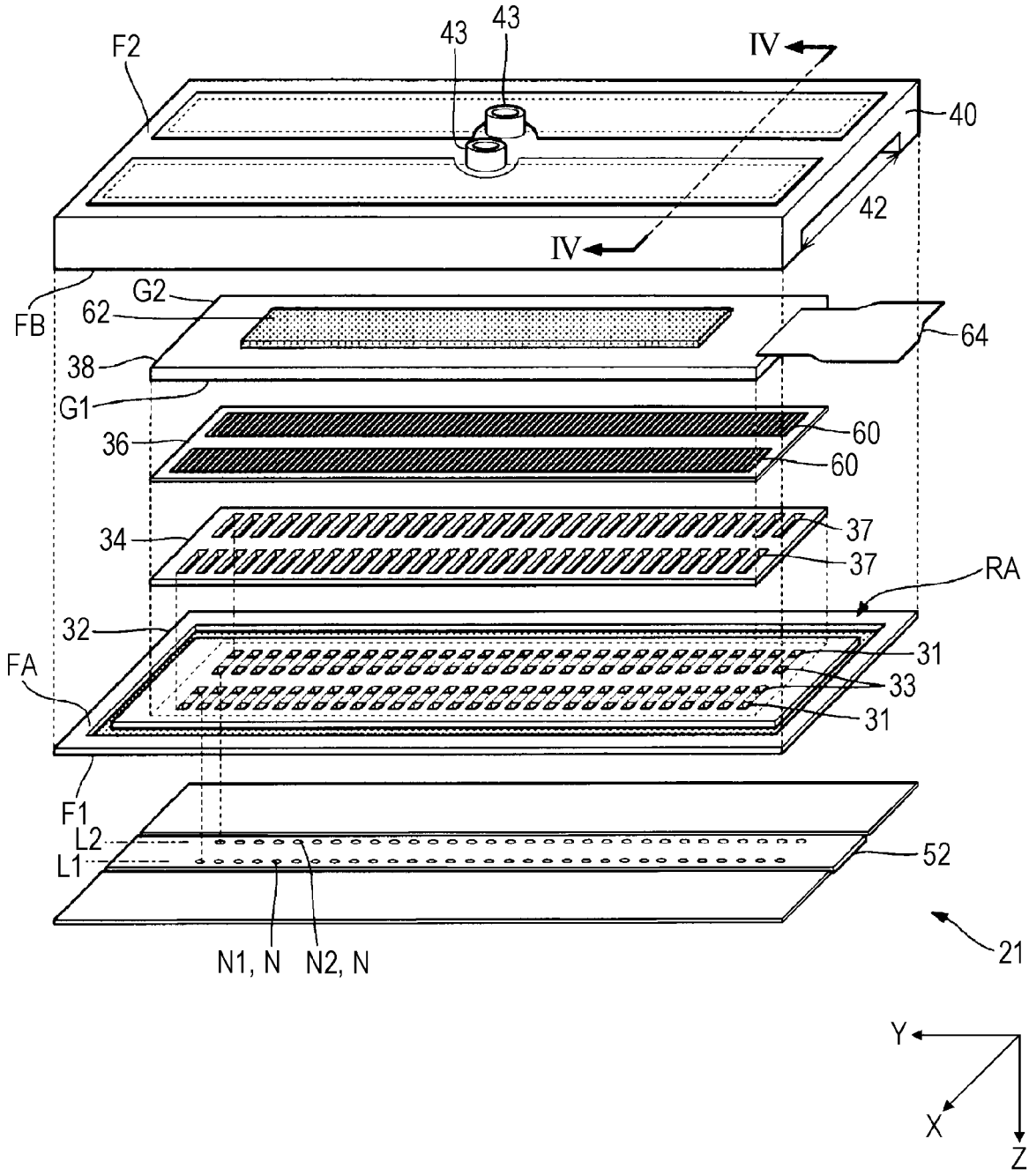
FIG. 3 is a disassembled perspective view of a liquid discharge head.
Figure 4:
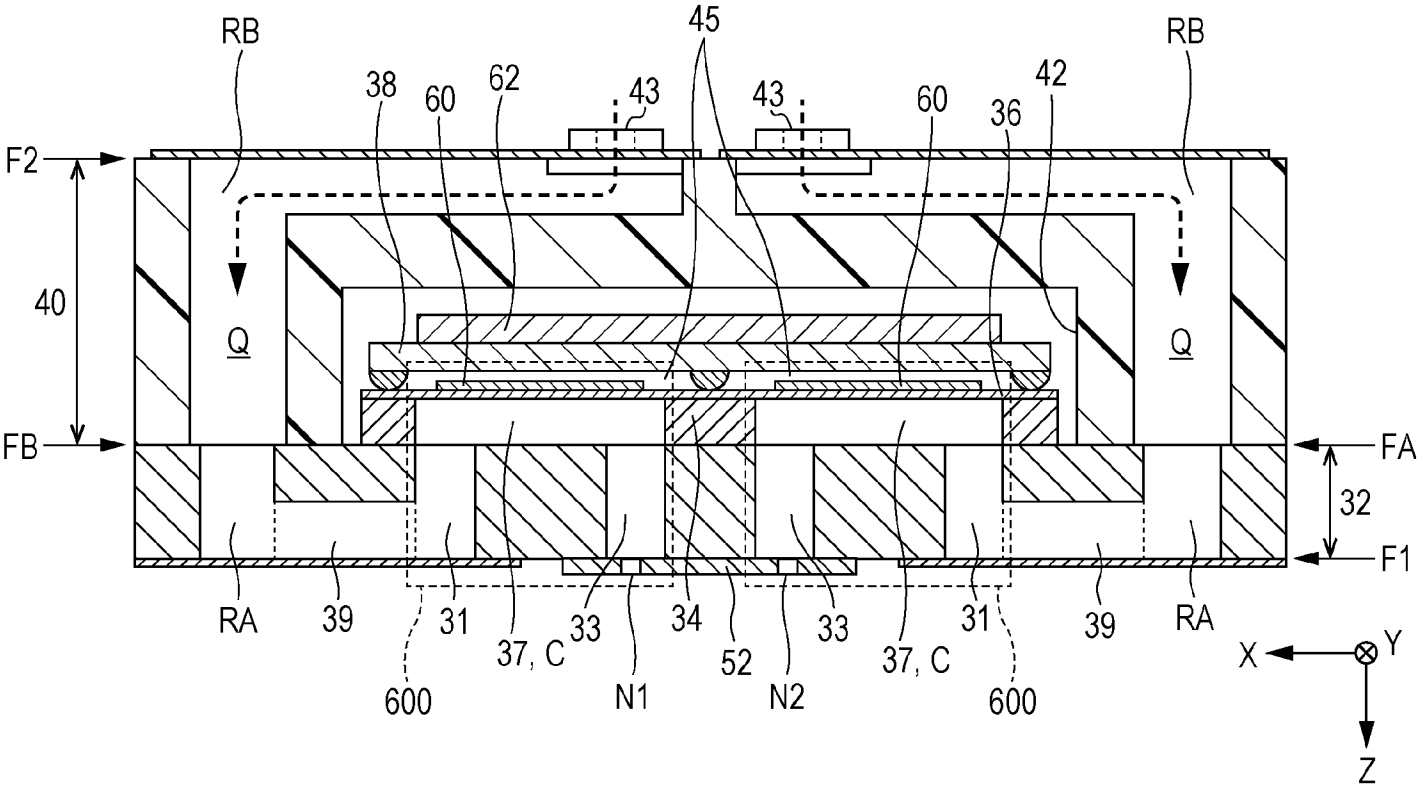
FIG. 4 is a cross-sectional view showing a cross section of the liquid discharge head taken along line IV-IV in FIG. 3.

A configuration of the liquid discharge head 21 will be described. FIG. 3 is a disassembled perspective view of a liquid discharge head 21. FIG. 4 is a cross-sectional view showing a cross section of the liquid discharge head 21 taken along the line IV-IV in FIG. 3.

As shown in FIG. 3, the liquid discharge head 21 includes 2M number of nozzles N arranged in the Y direction. In the present embodiment, 2M number nozzles N are arranged in two lines of a line L1 and a line L2. In the following description, each of the M number of nozzles N belonging to the line L1 will be referred to as nozzles N1, and each of the M number of nozzles N belonging to the line L2 will be referred to as nozzles N2. Further, in the following description, a case in which positions of a m-th (m is a natural number satisfying $1 \leq m \leq M$) nozzle N1 among the M number of nozzles N1 belonging to the line L1 and a m-th nozzle N2 among the M number of nozzles N2 belonging to the line L2 substantially coincide in the Y direction, is assumed. Here, "substantially coincide" includes not only cases where the positions are perfectly matched but also cases where the positions can be regarded as identical if margin of errors are considered. Note that 2M number of nozzles N may be arranged in so-called, a zigzag shape or a staggered shape, so that the position in the Y direction between the positions of the m-th nozzle N1 among the M number of nozzles N1 belonging to the line L1 and the m-th nozzle N2 among the M number of nozzles N2 belonging to the line L2 are different.

As shown in FIGS. 3 and 4, the liquid discharge head 21 includes a flow channel substrate 32. The flow channel substrate 32 is a plate-shaped member including a surface F1 and a surface FA. The surface F1 is a surface on the side of the medium P as viewed from the liquid discharge head 21, and the surface FA is a surface on the side opposite to the surface F1. On top of the surface of the surface FA, a pressure chamber substrate 34, a vibration substrate 36, a plurality of piezoelectric elements 60, an interposer substrate 38, and a housing portion 40 are provided. On top of the surface of the surface F1, a nozzle plate 52 and a vibration absorber 54 are provided. Each element of the liquid discharge head 21 is roughly a plate-shaped member elongated in the Y direction, and is stacked in the Z direction.

The nozzle plate 52 is a plate-shaped member, and 2M number of nozzles N, which are through holes, are formed in the nozzle plate 52. In the following description, 600 or more nozzles N are formed on the nozzle plate 52, and the nozzles N corresponding to each of the lines L1 and L2 are provided at a density of 300 or more nozzles per inch.

The flow channel substrate 32 is a plate-shaped member for forming a flow channel for ink. As shown in FIGS. 3 and 4, a flow channel RA is formed on the flow channel substrate 32. Further, on the flow channel substrate 32, 2M number of flow channels 31 and 2M number of flow channels 33 are formed so as to correspond to 2M number of nozzles N on a one-to-one basis. The flow channels 31 and the flow channels 33 are opening ports formed so as to pass through the flow channel substrate 32 as shown in FIG. 4. A flow channel 33 communicates with a nozzle N corresponding to the flow channel 33. Further, on the surface F1 of the flow channel substrate 32, two flow channels 39 are formed. One of the two flow channels 39 is a flow channel that connects the flow channel RA and M number of flow channels 31 corresponding one to one to the M number of nozzles N1 belonging to the line L1, and the other is a flow channel that connects the flow channel RA and M number of flow channels 31 corresponding one to one to the M number of nozzles N2 belonging to the line L2.

As shown in FIGS. 3 and 4, the pressure chamber substrate 34 is a plate-shaped member in which 2M number of opening ports 37 are formed so as to correspond to the 2M number of nozzles N in a one-to-one correspondence. On a surface of the pressure chamber substrate 34 opposite to the flow channel substrate 32, the vibration substrate 36 is provided.

As shown in FIG. 4, the vibration substrate 36 and the surface FA of the flow channel substrate 32 face each other with a space inside each opening port 37. The space located between the surface FA of the flow channel substrate 32 and the vibration substrate 36 inside the opening port 37 functions as a pressure chamber C for applying pressure to the ink filled in the space. The pressure chamber C is, for example, a space having an X axis as a longitudinal axis and a Y direction as a short axis. In the liquid discharge head 21, 2M number of pressure chambers C are provided so as to correspond to the 2M number of nozzles N on a one-to-one basis. The pressure chamber C provided corresponding to the nozzle N1 communicates with the flow channel RA via the flow channel 31 and the flow channel 39, and also communicates with the nozzle N1 via the flow channel 33. Further, the pressure chamber C provided corresponding to the nozzle N2 communicates with the flow channel RA via the flow channel 31 and the flow channel 39, and also communicates with the nozzle N2 via the flow channel 33.

As shown in FIGS. 3 and 4, on top of the surface of the vibration substrate 36 opposite to the pressure chamber C, 2M number of piezoelectric elements 60 are provided so as to correspond to the 2M number of pressure chambers C in a one-to-one basis. The drive signal VOUT based on the drive signals COMA and COMB is supplied to one end of the piezoelectric element 60, and the reference voltage signal VBS is supplied to the other end. The piezoelectric element 60 deforms (drives) in accordance with an electric potential difference between the drive signal VOUT and the reference voltage signal VBS. The vibration substrate 36 vibrates interlockingly with the deformation of the piezoelectric element 60, and when the vibration substrate 36 vibrates, a pressure in the pressure chamber C changes. As the pressure in the pressure chamber C changes, the ink filled in the pressure chamber C is discharged via the flow channel 33 and the nozzle N.

Note that the pressure chamber C, the flow channels 31 and 33, the nozzle N, the vibration substrate 36, and the piezoelectric element 60 function as the discharge unit 600 for discharging the ink filled in the pressure chamber C by driving the piezoelectric element 60. That is, in the liquid discharge head 21, a plurality of discharge units 600 are arranged in two lines along the Y direction.

The interposer substrate 38 shown in FIGS. 3 and 4 has a surface G1 and a surface G2 oppose the surface G1, and propagates drive signals COMA and COMB to the drive IC 62. The interposer substrate 38 is a plate-shaped member for protecting the 2M number of piezoelectric elements 60 formed on the vibration substrate 36, and is provided on the surface of the vibration substrate 36 or the surface of the pressure chamber substrate 34.

Two accommodation spaces 45 are formed on the surface G1 of the interposer substrate 38, which is a surface on the side of the medium P as viewed from the liquid discharge head 21. One of the two accommodation spaces 45 is a space for accommodating M number of piezoelectric elements 60 corresponding to the M number of nozzles N1 and the other is a space for accommodating M number of piezoelectric elements 60 corresponding to the M number of nozzles N2. A height which is a width in a Z direction of the accommodation space 45 is sufficiently large so that the piezoelectric element 60 and the interposer substrate 38 do not come into contact with each other even when the piezoelectric element 60 is displaced.

The drive IC 62 is provided on the surface G2 of the interposer substrate 38, which is a surface on the side opposite to the surface G1. For example, the drive signal selection circuit 200 shown in FIG. 2 is mounted on the drive IC 62. The drive signals COMA and COMB, the printing data signal SI, the change signal CH, the latch signal LAT and the clock signal SCK input to the liquid discharge head 21 are input to the drive IC 62. Then, based on the printing data signal SI, the drive IC 62 generates and outputs a drive signal VOUT by switching whether or not to supply the drive signals COMA and COMB to each piezoelectric element 60. That is, the drive IC 62 controls a supply of the drive signals COMA and COMB to the piezoelectric element 60.

A plurality of wirings are provided on the interposer substrate 38 for propagating the drive signals COMA, COMB, and VOUT, the print data signal SI, the change signal CH, the latch signal LAT and the clock signal SCK. The drive signal VOUT output from the drive IC 62 is supplied to the piezoelectric element 60 via the wiring.

In addition, a connection wiring 64 is electrically connected to the interposer substrate 38. The connection wiring 64 is a member in which a plurality of wirings for transferring a plurality of signals input to the liquid discharge head 21 to the drive IC 62 are formed, and may be, for example, an flexible printed circuit (FPC), an flexible flat cable (FFC), or the like. Details of the plurality of wirings formed on the interposer substrate 38 will be described later.

An operation in which one of the drive signals COMA and COMB is selected in the drive IC 62 and the drive signal VOUT is generated, will be described. The drive IC 62 generates and outputs the drive signal VOUT supplied to the piezoelectric element 60 by selecting or deselecting the drive signals COMA and COMB based on the printing data signal SI, the change signal CH, and the latch signal LAT.

The latch signal LAT defines a printing cycle Ta, which is a cycle for forming dots on the medium P. Specifically, a cycle from a generation of the latch signal LAT to a next generation of the latch signal LAT becomes the printing cycle Ta. Further, the change signal CH divides the printing cycle Ta into a plurality of cycles Tn (n is a positive integer). The printing data signal SI includes data signals corresponding to each of a plurality of discharge units 600, and selects or deselects each of the drive signals COMA and COMB for each cycle Tn. In this way, the drive IC 62 generates the drive signal VOUT in the printing cycle Ta by selecting or deselecting each of the drive signals COMA and COMB for each cycle Tn based on the printing data signal SI.

Figure 5:
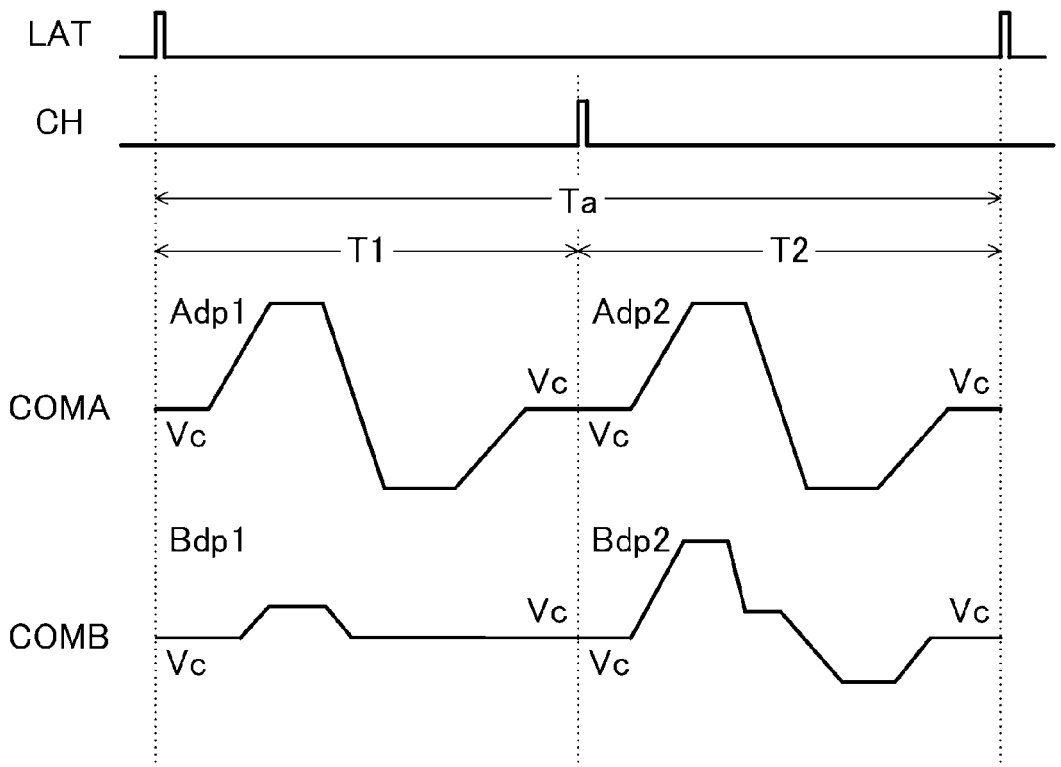
FIG. 5 is a diagram showing an example of drive signals.

A generation procedure of the drive signal VOUT in the drive IC 62 will be described by taking the drive signals COMA and COMB shown in FIG. 5 as an example. Note that the printing cycle Ta in FIG. 5 is configured with two cycles, which are a cycle T1 from a generation of the latch signal LAT to a generation of the change signal CH and a cycle T2 from a generation of the change signal CH to a generation of the latch signal LAT.

The drive signal COMA is a signal configured with a waveform in which a trapezoidal waveform Adp1 disposed in the cycle T1 and a trapezoidal waveform Adp2 disposed in the cycle T2 are continuous. The trapezoidal waveforms Adp1 and Adp2 have substantially the same waveforms, and when each of the waveforms is supplied to one end of the piezoelectric element 60, a moderate amount of ink is discharged from the corresponding nozzle N of the discharge unit 600.

The drive signal COMB is a signal configured with a waveform in which a trapezoidal waveform Bdp1 disposed in the cycle T1 and a trapezoidal waveform Bdp2 disposed in the cycle T2 are continuous. The trapezoidal waveforms Bdp1 and Bdp2 have different waveforms, and among the waveforms, the trapezoidal waveform Bdp1 is a waveform for slightly vibrating the ink in the vicinity of the opening portion of the nozzle N to prevent viscosity of the ink from increasing. Therefore, even if the trapezoidal waveform Bdp1 is supplied to one end of the piezoelectric element 60, an ink droplet is not discharged from the corresponding nozzle N of the discharge unit 600. The trapezoidal waveform Bdp2 is a waveform different from that of both of the trapezoidal waveforms Adp1 and Adp2, and when the trapezoidal waveform Bdp2 is supplied to one end of the piezoelectric element 60, a small amount of ink less than the moderate amount is discharged from the corresponding nozzle N of the discharge unit 600.

Based on the printing data signal SI, the drive IC 62 generates the drive signal VOUT by controlling whether to supply each of the drive signals COMA and COMB to each of the piezoelectric elements 60 included in the plurality of discharge units 600 in the cycle T1 and the cycle T2.

For example, when the printing data signal SI is a signal indicating "large dot", the drive signal COMA is selected in the cycles T1 and T2. As a result, the drive IC 62 outputs the drive signal VOUT configured with a waveform in which the trapezoidal waveform Adp1 and the trapezoidal waveform Adp2 are continuous in the printing cycle Ta. At this time, a moderate amount of ink is discharged twice from the nozzle N corresponding to the piezoelectric element 60 to which the drive signal VOUT is supplied. Therefore, a large dot is formed on the medium P.

Further, when the printing data signal SI is a signal indicating "medium dot", the drive signal COMA is selected in the cycle T1, and the drive signal COMB is selected in the cycle T2. As a result, the drive IC 62 outputs the drive signal VOUT configured with a waveform in which the trapezoidal waveform Adp1 and the trapezoidal waveform Bdp2 are continuous in the printing cycle Ta. At this time, a moderate amount of ink and a small amount of ink are discharged from the nozzle N corresponding to the piezoelectric element 60 to which the drive signal VOUT is supplied. Therefore, a medium dot is formed on the medium P.

Further, when the printing data signal SI is a signal indicating "small dot", neither the drive signals COMA and COMB are selected in the cycle T1, and the drive signal COMB is selected in the cycle T2. As a result, the drive IC 62 outputs the drive signal VOUT configured with the trapezoidal waveform Bdp2 in the printing cycle Ta. At this time, a small amount of ink is discharged from the nozzle N corresponding to the piezoelectric element 60 to which the drive signal VOUT is supplied. Therefore, a small dot is formed on the medium P.

Further, when the printing data signal SI is a signal indicating "micro vibration", the drive signal COMB is selected in the cycle T1, and neither the drive signals COMA nor COMB are selected in the cycle T2. As a result, the drive IC 62 outputs the drive signal VOUT configured with the trapezoidal waveform Bdp1 in the printing cycle Ta. At this time, the piezoelectric element 60 to which the drive signal VOUT is supplied is driven to such an extent that the ink is not discharged, and the ink is not discharged from the nozzle N corresponding to the piezoelectric element 60. Therefore, a dot is not formed on the medium P.

A voltage at the start timing of the trapezoidal waveforms Adp1, Adp2, Bdp1, and Bdp2 and a voltage at the end timing are common to the voltage Vc. That is, each of the drive signals COMA and COMB is configured with a waveform starting at the voltage Vc and ending at the voltage Vc. Note that the drive signals COMA and COMB shown in FIG. 5 are examples and are not limited thereto.

Returning to FIG. 3 and FIG. 4, a housing portion 40 is a case for storing the ink supplied to the 2M number of pressure chambers C. A surface FB of the casing portion 40, which is a surface on the side of the medium P as viewed from the liquid discharge head 21, is for example, fixed to the surface FA of the flow channel substrate 32 with an adhesive. On the surface FB of the casing portion 40, a groove-shaped concave portion 42 extending in the Y direction is formed. The interposer substrate 38 and the drive IC 62 are accommodated inside the concave portion 42. At this time, the connection wiring 64 is extended in the Y direction so as to pass through inside of the concave portion 42.

The housing portion 40 is formed by, for example, injection molding of a resin material. As shown in FIG. 4, a flow channel RB communicating with the flow channel RA is formed in the housing portion 40. The flow channel RA and the flow channel RB function as a reservoir Q that stores the ink to be supplied to the 2M number of pressure chambers C.

On the surface F2 which is a surface opposite to the surface FB of the housing portion 40, two introducing ports 43 for introducing the ink supplied from the liquid container 2 to the reservoir Q, are provided. The ink supplied from the liquid container 2 to the two introducing ports 43 flows into the flow channel RA via the flow channel RB. A part of the ink flowed into the flow channel RA is supplied to the pressure chamber C corresponding to the nozzle N via the flow channel 39 and the flow channel 31. The ink filled in the pressure chamber C corresponding to the nozzle N is discharged from the nozzle N via the flow channel 33 by driving the piezoelectric element 60 corresponding to the nozzle N.

Figure 6:
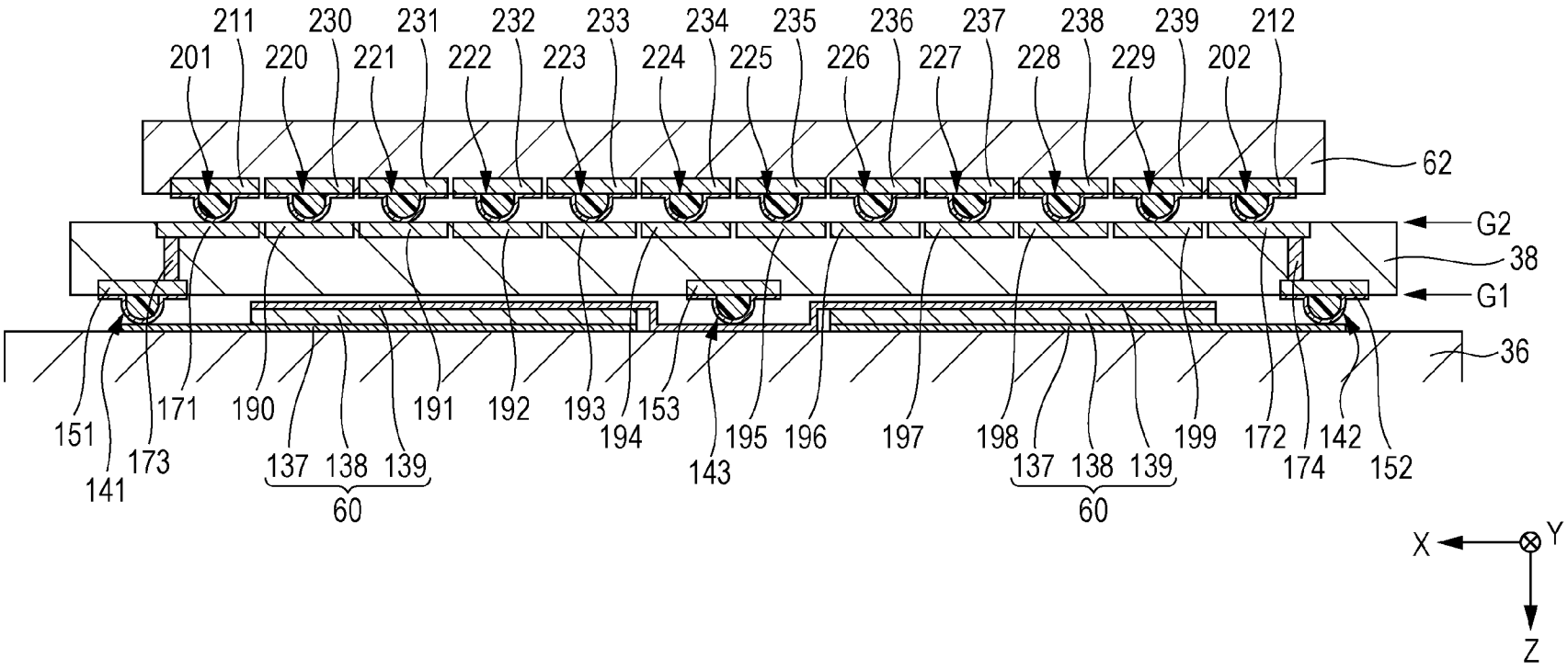
FIG. 6 is a diagram for explaining electrical connectings of a drive IC, an interposer substrate, an actuator substrate, and piezoelectric elements.

1.4 Configuration of Electrical Connections of Drive IC, Wiring Substrate and Actuator Substrate Next, electrical connections of the drive IC 62, the interposer substrate 38, the vibration substrate 36, and the piezoelectric element 60 will be described with reference to FIG. 6. FIG. 6 is a diagram for explaining electrical connections of the drive IC 62, the interposer substrate 38, the vibration substrate 36, and piezoelectric elements 60.

The vibration substrate 36 is a plate-shaped member and can vibrate. On an upper surface of the vibration substrate 36 in the Z direction, a plurality of piezoelectric elements 60 are arranged in two lines in the Y direction as shown in FIG. 3. In each piezoelectric element 60, a lower electrode layer 137, a piezoelectric layer 138, and an upper electrode layer 139 are sequentially stacked along the Z direction on an upper surface of the vibration substrate 36. The piezoelectric layer 138 is displaced in accordance with an electric potential difference generated between the lower electrode layer 137 and the upper electrode layer 139 of the piezoelectric element 60 configured as described above, and the vibration substrate 36 is deformed in the Z direction in accordance with the displacement of the piezoelectric layer 138.

In FIG. 6, the lower electrode layer 137 is an individual electrode that supplies the drive signal VOUT to each piezoelectric element 60, and the upper electrode layer 139 is a common electrode common to supply the reference voltage signal VBS to the plurality of piezoelectric elements 60. Note that the lower electrode layer 137 may be a common electrode and the upper electrode layer 139 may be an individual electrode.

The interposer substrate 38 is stacked on the upper surface of the vibration substrate 36 in the Z direction. On the interposer substrate 38, a plurality of wirings and electrodes for supplying various signals to the vibration substrate 36 are provided. Details of the plurality of wirings and electrodes provided on the interposer substrate 38 will be described later.

On the surface G1 of the interposer substrate 38, bump electrodes 141 and 142 for supplying the drive signal VOUT output from the drive IC 62 to the corresponding piezoelectric element 60 are provided. The bump electrode 141 is provided inside the plurality of piezoelectric elements 60 arranged in two lines, for example, at a position corresponding to the lower electrode layer 137 of the piezoelectric element 60 corresponding to the nozzle N1 included in the line L1 shown in FIG. 3. The bump electrode 141 and the lower electrode layer 137 are electrically connected to each other, whereby the drive signal VOUT is supplied to the piezoelectric element 60. Further, the bump electrode 141 is also electrically connected to an electrode 151 formed on the surface G1 of the interposer substrate 38.

The bump electrode 142 is provided inside the plurality of piezoelectric elements 60 arranged in two lines, for example, at a position corresponding to the lower electrode layer 137 of the piezoelectric element 60 corresponding to the nozzle N2 included in the line L2 shown in FIG. 3. The bump electrode 142 and the lower electrode layer 137 are electrically connected to each other, whereby the drive signal VOUT is supplied to the piezoelectric element 60. Further, the bump electrode 142 is also electrically connected to an electrode 152 formed on the surface G1 of the interposer substrate 38.

A bump electrode 143 for supplying the reference voltage signal VBS to the piezoelectric element 60 is provided on the surface G1 of the interposer substrate 38. The bump electrode 143 is provided at a position corresponding to the upper electrode layer 139 of the piezoelectric element 60. The bump electrode 143 and the upper electrode layer 139 are electrically connected to each other, whereby the reference voltage signal VBS is supplied to the piezoelectric element 60. Further, the bump electrode 143 is also electrically connected to an electrode 153 formed on the surface G1 of the interposer substrate 38.

An electrode 171 corresponding to the electrode 151 is formed on the surface G2 of the interposer substrate 38 on the side opposite to the surface G1. The electrode 151 and the electrode 171 are electrically connected by a through-wiring 173 passing through the interposer substrate 38. An electrode 172 corresponding to the electrode 152 is formed on the surface G2 of the interposer substrate 38. The electrode 152 and the electrode 172 are electrically connected by a through-wiring 174 passing through the interposer substrate 38.

On the surface G2 of the interposer substrate 38, electrodes 190 to 199 are formed between the electrode 171 and the electrode 172. Specifically, the electrodes 190 to 199 are arranged in the order of the electrodes 190, 191, 192, 193, 194, 195, 196, 197, 198, and 199 in a direction from the electrode 171 toward the electrode 172 between the electrode 171 and the electrode 172.

The drive IC 62 is mounted on the upper surface of the interposer substrate 38 in the Z direction. A bump electrode 201 is provided, on a surface of the drive IC 62 facing the interposer substrate 38 and in a region facing the electrode 171 of the interposer substrate 38. Further, the bump electrode 201 is also electrically connected to an electrode 211 formed on the drive IC 62. Similarly, a bump electrode 202 is provided, on a surface of the drive IC 62 facing the interposer substrate 38 and in a region facing the electrode 172 of the interposer substrate 38. Further, the bump electrode 202 is also electrically connected to an electrode 212 formed on the drive IC 62.

Bump electrodes 220 to 229 are provided, on a surface of the drive IC 62 facing the interposer substrate 38 and in a region facing each of the electrodes 190 to 199 of the interposer substrate 38. Further, each of the bump electrodes 220 to 229 is electrically connected to each of the electrodes 230 to 239 formed on the drive IC 62.

Configurations of the bump electrodes 141 to 143, 201, 202, and 220 to 229 which are electrically connected to the drive IC 62, the interposer substrate 38 and the vibration substrate 36, respectively, will be described with reference to FIG. 7. Note that the bump electrodes 141 to 143, 201, 202, and 220 to 229 have the same configuration, and in the description of FIG. 7, a bump electrode 240 will be described.

Figure 7:
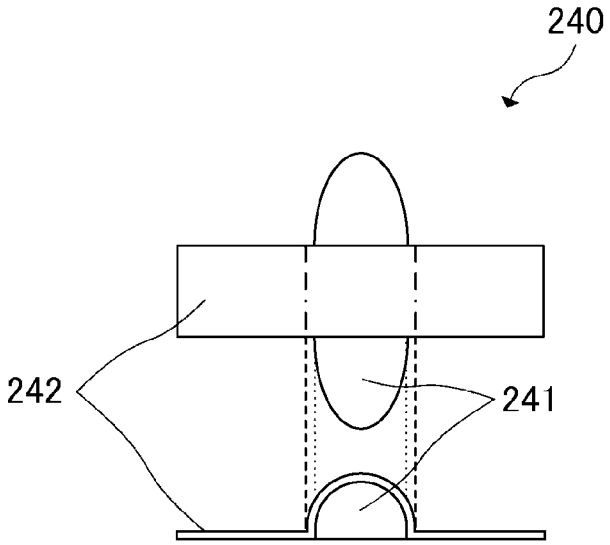
FIG. 7 is a diagram showing an example of a configuration of a bump electrode.

FIG. 7 is a diagram showing an example of a configuration of a bump electrode 240. A top view in FIG. 7 shows a plan view of the bump electrode 240, and a bottom view in FIG. 7 shows a side view of the bump electrode 240. The bump electrode 240 is a resin core bump including a resin core portion 241 protrudingly provided, and a metal electrode 242 formed on the upper part of the core portion 241. In such a bump electrode 240, a spacing between the bump electrodes 240 can be reduced since a space between patterns of the electrodes 242 can be constituted by an insulator core portion 241.

Note that in the present embodiment, although the bump electrode 240 is illustrated and described as including the core portion 241 and the electrode 242 individually, a plurality of bump electrodes 240 may be formed by forming a plurality of electrodes 242 on an upper part of the core portion 241 provided in common.

In addition, each of the drive IC 62, the interposer substrate 38, and the vibration substrate 36 may be electrically connected by a method other than the bump electrode 240 described above. For example, each of the drive IC 62, the interposer substrate 38, and the vibration substrate 36 may be electrically connected by gold bumps. Each of the drive IC 62, the interposer substrate 38, and the vibration substrate 36 is joined by a bonding technology using adhesion such as a conductive adhesive, a non-conductive adhesive, an anisotropic conductive adhesive, or the like in a state of being electrically connected by the bump electrode 240.

1.5 Configuration of Interposer Substrate and Actuator Substrate

Figure 8:
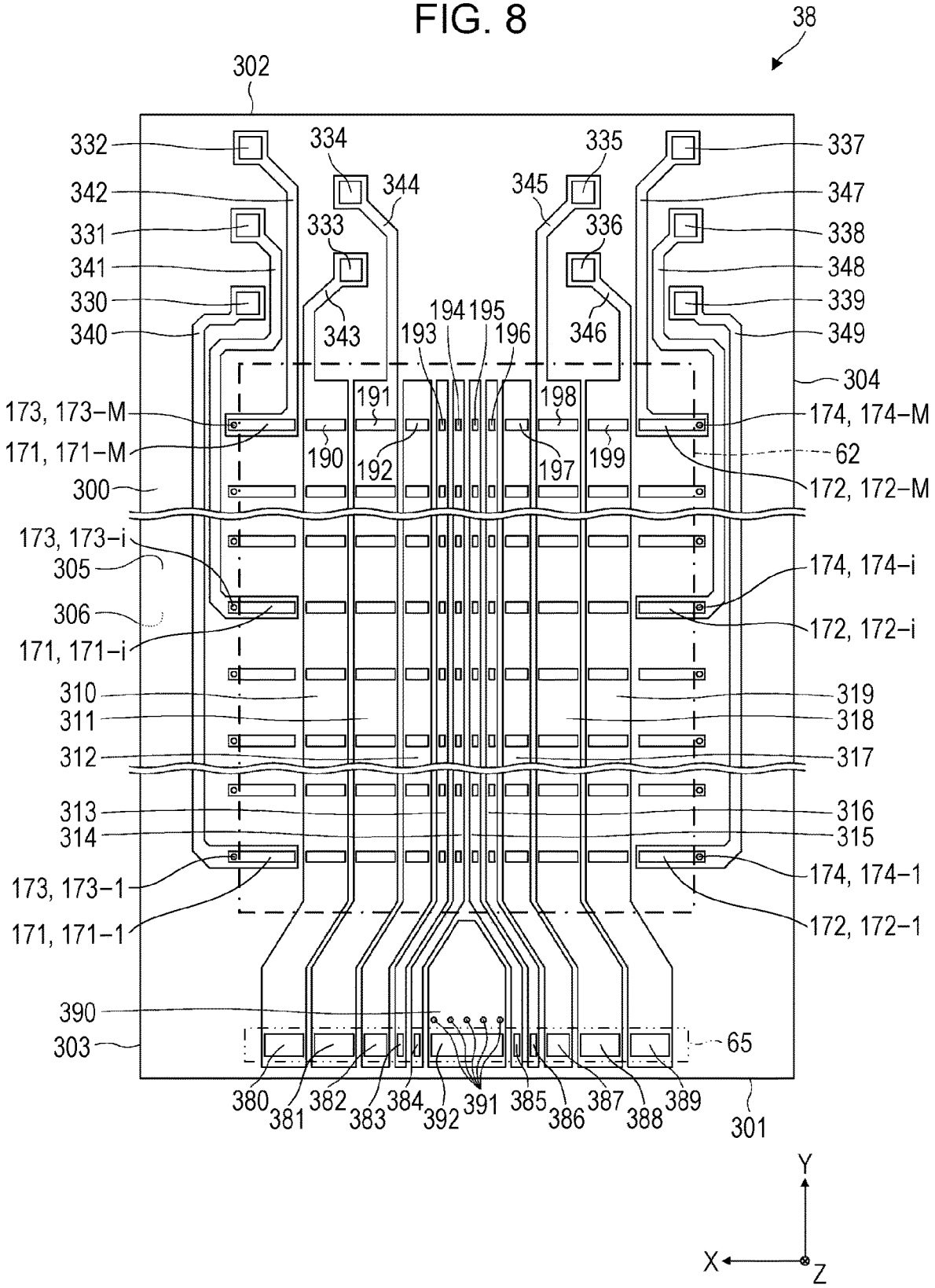
FIG. 8 is a plan view showing a configuration when the interposer substrate is viewed from a surface.
Figure 9:
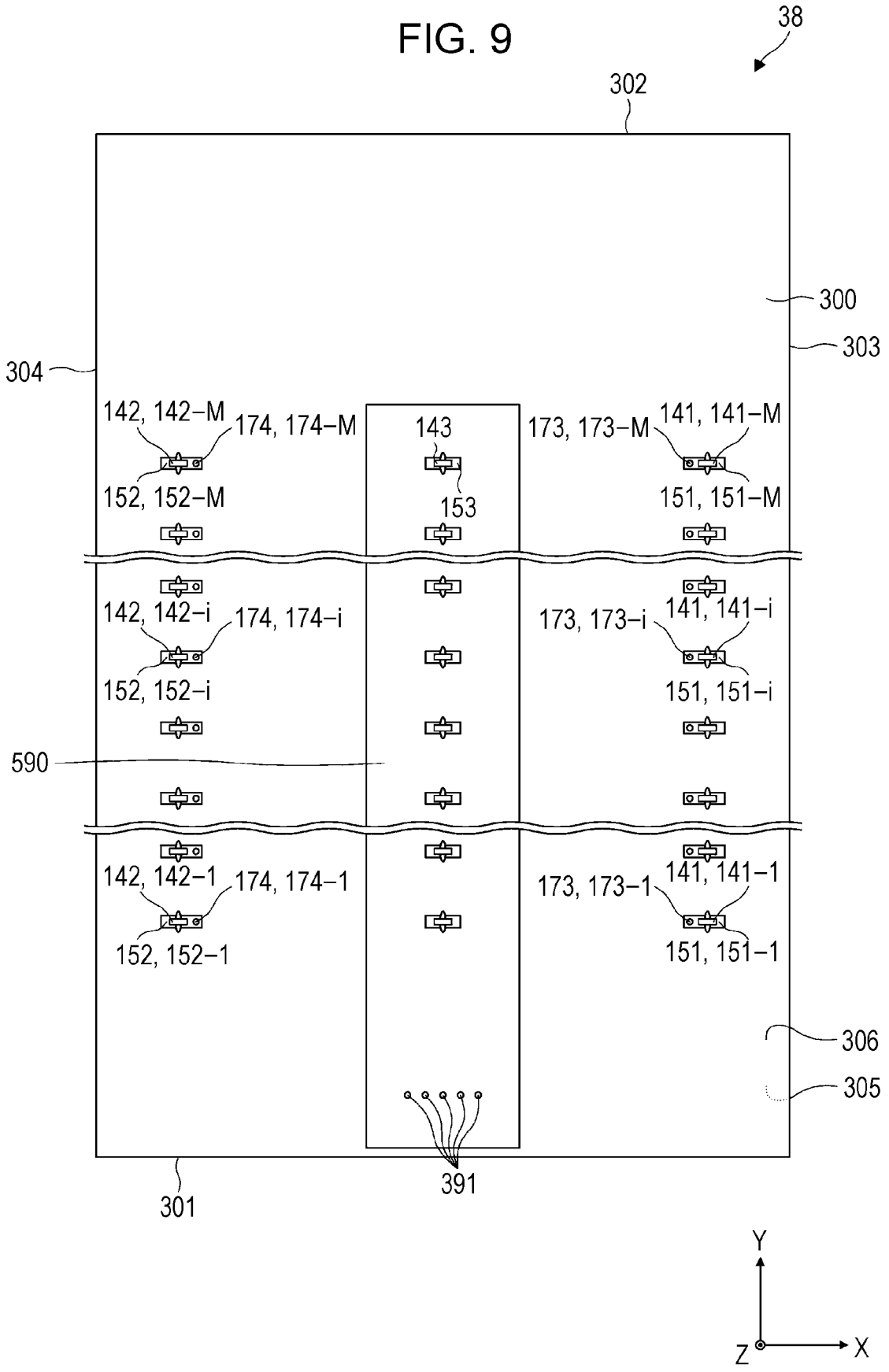
FIG. 9 is a plan view showing a configuration when the interposer substrate is viewed from a surface.
Figure 10:
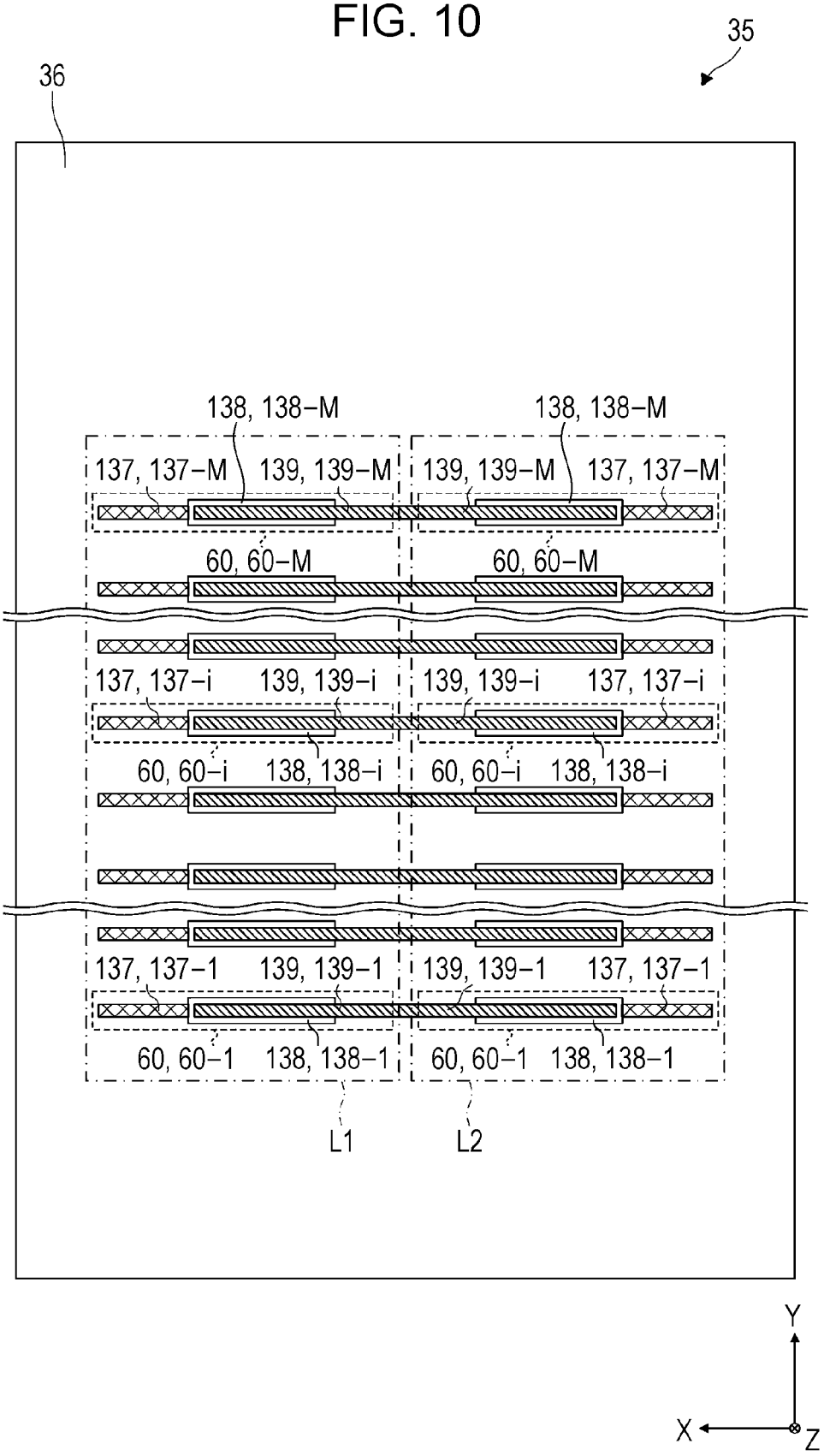
FIG. 10 is a plan view showing a surface on the interposer substrate side of the actuator substrate, and on which piezoelectric elements are formed.

Details of the interposer substrate 38 and the vibration substrate 36 will be described with reference to FIG. 6, and FIGS. 8 to 10. FIG. 8 is a plan view showing a configuration when the interposer substrate 38 is viewed from the surface G2. In FIG. 8, the drive ICs 62 mounted on the interposer substrate 38 are indicated by one-dot chain lines. FIG. 9 is a plan view showing a configuration when the interposer substrate 38 is viewed from the surface G1. FIG. 10 is a plan view showing a surface which is on the interposer substrate 38 side of the actuator substrate 35 including the vibration substrate 36, and on which piezoelectric elements 60 are formed. Note that the interposer substrate 38 described below is an example of a wiring substrate in the present embodiment.

As shown in FIGS. 8 and 9, the interposer substrate 38 includes a substrate 300. The substrate 300 has a first surface 305 and a second surface 306 opposite to the first surface 305. In addition, the substrate 300 has a substantially rectangular shape formed by a side 301, a side 302 facing the side 301, a side 303 longer than the side 301, and a side 304 facing the side 303. Here, the side 301 or the side 302 is an example of a first side, and the side 303 or the side 304 is an example of a second side. Further, on the substrate 300, a connection wiring region 65 including a plurality of electrodes to which the connection wiring 64 is connected, a plurality of wirings, and a plurality of electrodes, are formed. Note that the first surface 305 of the substrate 300 is a surface having the same direction as the surface G2 of the interposer substrate 38 and the second surface 306 of the substrate 300 is a surface having the same direction as the surface G1 of the interposer substrate 38.

As shown in FIG. 8, electrodes 380 to 389 and 392 to which the connection wiring 64 is electrically connected are formed in the connection wiring region 65.

As shown in FIG. 8, the electrode 380 is formed on the wiring 310. The electrode 380 electrically connectes the wiring 310 with the connection wiring 64. The wiring 310 is a wiring pattern formed along the Y direction from the side 301 toward the side 302 on the first surface 305 of the substrate 300. The drive signal COMA is supplied to the electrode 380. The wiring 310 propagates the drive signal COMA input via the electrode 380. Further, an electrode 190 is formed on the wiring 310. The electrode 190 is electrically connected to the bump electrode 220 as shown in FIG. 6. As a result, the drive signal COMA supplied via the electrode 380 is propagated through the wiring 310 and then supplied to the drive IC 62 via the bump electrode 220. In the present embodiment, M number of electrodes 190 are formed on the wiring 310 corresponding to each of the M number of nozzles N1 forming the line L1. In addition, M number of bump electrodes 220 are provided corresponding to the M number of electrodes 190.

The electrode 381 is formed on the wiring 311. The electrode 381 electrically connectes the wiring 311 with the connection wiring 64. The wiring 311 is a wiring pattern formed along the Y direction from the side 301 toward the side 302 on the side 304 side of the wiring 310 on the first surface 305 of the substrate 300. The drive signal COMB is supplied to the electrode 381. The wiring 311 propagates the drive signal COMB input via the electrode 381. Further, an electrode 191 is formed on the wiring 311. The electrode 191 is electrically connected to the bump electrode 221 as shown in FIG. 6. As a result, the drive signal COMB supplied via the electrode 381 is propagated through the wiring 311 and then supplied to the drive IC 62 via the bump electrode 221. In the present embodiment, M number of electrodes 191 are formed on the wiring 311 corresponding to each of the M number of nozzles N1 forming the line L1. In addition, M number of bump electrodes 221 are provided corresponding to the M number of electrodes 191.

The electrode 382 is formed on the wiring 312. The electrode 382 electrically connectes the wiring 312 with the connection wiring 64. The wiring 312 is a wiring pattern formed along the Y direction from the side 301 toward the side 302 on the side 304 side of the wiring 311 on the first surface 305 of the substrate 300. The high voltage signal VHV is supplied to the electrode 382. The wiring 312 propagates the high voltage signal VHV input via the electrode 382. Further, an electrode 192 is formed on the wiring 312. The electrode 192 is electrically connected to the bump electrode 222 as shown in FIG. 6. As a result, the high voltage signal VHV supplied via the electrode 382 is propagated through the wiring 312 and then supplied to the drive IC 62 via the bump electrode 222. In the present embodiment, M number of electrodes 192 are formed on the wiring 312 corresponding to each of the M number of nozzles N1 or nozzles N2 forming the line L1 or the line L2. In addition, M number of bump electrodes 222 are provided corresponding to the M number of electrodes 192.

Each of the electrodes 383 to 386 is formed on each wiring of the wirings 313 to 316. Each of the electrodes 383 to 386 electrically connectes each of the wirings 313 to 316 with the connection wiring 64. The wiring 313 is a wiring pattern formed along the Y direction from the side 301 toward the side 302 on the side 304 side of the wiring 312 on the first surface 305 of the substrate 300. The wiring 313 propagates the printing data signal SI input via the electrode 383. The wiring 314 is a wiring pattern formed along the Y direction from the side 301 toward the side 302 on the side 304 side of the wiring 313 on the first surface 305 of the substrate 300. The wiring 314 propagates the change signal CH input via the electrode 384. The wiring 315 is a wiring pattern formed along the Y direction from the side 301 toward the side 302 on the side 304 side of the wiring 314 on the first surface 305 of the substrate 300. The wiring 315 propagates the latch signal LAT input via the electrode 385. The wiring 316 is a wiring pattern formed along the Y direction from the side 301 toward the side 302 on the side 304 side of the wiring 315 on the first surface 305 of the substrate 300. The wiring 316 propagates the clock signal SCK input via the electrode 386.

Each of electrodes 193 to 196 is formed on each wiring of the wirings 313 to 316. Each of the electrodes 193 to 196 is electrically connected to each of the bump electrodes 223 to 226 as shown in FIG. 6. As a result, the printing data signal SI, the change signal CH, the latch signal LAT, and the clock signal SCK are supplied to the drive IC 62. In the present embodiment, each of the electrodes 193 to 196 is formed by M number of electrodes along the Y direction corresponding to the M number of nozzles N1 or nozzles N2 forming the line L1 or L2. In addition, each of the bump electrodes 223 to 226 is formed by M number of bump electrodes corresponding to each of the electrodes 193 to 196.

The electrode 387 is formed on the wiring 317. The electrode 387 electrically connectes the wiring 317 with the connection wiring 64. The wiring 317 is a wiring pattern formed along the Y direction from the side 301 toward the side 302 on the side 304 side of the wiring 316 on the first surface 305 of the substrate 300. The low voltage signal VDD is supplied to the electrode 387. The wiring 317 propagates the low voltage signal VDD input via the electrode 387. Further, an electrode 197 is formed on the wiring 317. The electrode 197 is electrically connected to the bump electrode 227 as shown in FIG. 6. As a result, the low voltage signal VDD supplied via the electrode 387 is propagated through the wiring 317 and then supplied to the drive IC 62 via the bump electrode 227. In the present embodiment, M number of electrodes 197 are formed on the wiring 317 corresponding to each of the M number of nozzles N1 or nozzles N2 forming the line L1 or the line L2. In addition, M number of bump electrodes 227 are provided corresponding to the M number of electrodes 197.

The electrode 388 is formed on the wiring 318. The electrode 388 electrically connectes the wiring 318 with the connection wiring 64. The wiring 318 is a wiring pattern formed along the Y direction from the side 301 toward the side 302 on the side 304 side of the wiring 317 on the first surface 305 of the substrate 300. The drive signal COMB is supplied to the electrode 388. The wiring 318 propagates the drive signal COMB input via the electrode 388. Further, an electrode 198 is formed on the wiring 318. The electrode 198 is electrically connected to the bump electrode 228 as shown in FIG. 6. As a result, the drive signal COMB supplied via the electrode 388 is propagated through the wiring 318 and then supplied to the drive IC 62 via the bump electrode 228. In the present embodiment, M number of electrodes 198 are formed on the wiring 318 corresponding to each of the M number of nozzles N2 forming the line L2. In addition, M number of bump electrodes 228 are provided corresponding to the M number of electrodes 198.

The electrode 389 is formed on the wiring 319. The electrode 389 electrically connectes the wiring 319 with the connection wiring 64. The wiring 319 is a wiring pattern formed along the Y direction from the side 301 toward the side 302 on the side 304 side of the wiring 318 on the first surface 305 of the substrate 300. The drive signal COMA is supplied to the electrode 389. The wiring 319 propagates the drive signal COMA input via the electrode 389. Further, an electrode 199 is formed on the wiring 319. The electrode 199 is electrically connected to the bump electrode 229 as shown in FIG. 6. As a result, the drive signal COMA supplied via the electrode 389 is propagated through the wiring 319 and then supplied to the drive IC 62 via the bump electrode 229. In the present embodiment, M number of electrodes 199 are formed on the wiring 319 corresponding to each of the M number of nozzles N2 forming the line L2. In addition, M number of bump electrodes 229 are provided corresponding to the M number of electrodes 199.

As described above, the drive signals COMA and COMB, the high voltage signal VHV, the low voltage signal VDD, the printing data signal SI, the change signal CH, the latch signal LAT and the clock signal SCK, which are input to the interposer substrate 38 via the connection wiring 64, are supplied to the drive ICs 62. The number of the electrodes 190 to 199 and the bump electrodes 220 to 229 connection the interposer substrate 38 with the drive ICs 62 does not have to match the number of the nozzles N1 or N2 forming the line L1 and the line L2. That is, the number of the electrodes 190 to 199 and the bump electrodes 220 to 229 provided on the interposer substrate 38 may be M pieces or more, and may be less than M pieces.

The electrode 392 is formed on the wiring 390. The electrode 392 electrically connectes the wiring 390 with the connection wiring 64. The wiring 390 is formed between the wiring 314 and the wiring 315 which are formed on the first surface 305 of the substrate 300, and is formed on a side of the side 301. The reference voltage signal VBS is supplied to the electrode 392. A through-wiring 391 passing through the substrate 300 and electrically connected to the wiring 390, is formed on a wiring 390.

As shown in FIG. 9, the through-wiring 391 is electrically connected to the wiring 590 formed on the second surface 306. That is, the through-wiring 391 passes through the substrate 300 and electrically connectes the wirings 390 with 590. As a result, the reference voltage signal VBS input via the electrode 392 is propagated through the wiring 590 via the wiring 390 and the through-wiring 391. An electrode 153 is formed on the wiring 590. A bump electrode 143 is provided on the electrode 153. As shown in FIG. 6, the bump electrode 143 is electrically connected to an upper electrode layer 139 of the piezoelectric element 60 provided on the vibration substrate 36. As a result, the reference voltage signal VBS is supplied to the piezoelectric element 60 via the electrode 153 and the bump electrode 143.

As shown in FIG. 8, an electrode 171 is formed on the side 303 side of the wiring 310 on the first surface 305 of the substrate 300. The drive signal VOUT supplied from the drive IC 62 to the piezoelectric element 60 corresponding to the nozzle N1 is output to the electrode 171. Further, a through-wiring 173 passing through the substrate 300 and electrically connected to the electrode 171, is formed on a side 303 side of the electrode 171. As shown in FIG. 9, the through-wiring 173 is electrically connected to the electrode 151 on the second surface 306. In addition, a bump electrode 141 is provided on the electrode 151. As shown in FIG. 6, the bump electrode 141 is electrically connected to a lower electrode layer 137 of the nozzle N1 forming the line L1, among the piezoelectric elements 60 provided on the vibration substrate 36. As a result, the drive signal VOUT is supplied to the piezoelectric element 60 via the electrode 151 and the bump electrode 141.

As shown in FIG. 8, an electrode 172 is formed on the side 304 side of the wiring 319 on the first surface 305 of the substrate 300. The drive signal VOUT supplied from the drive IC 62 to the piezoelectric element 60 corresponding to the nozzle N2 is output to the electrode 172. Further, a through-wiring 174 passing through the substrate 300 and electrically connected to the electrode 172, is formed on a side 304 side of the electrode 172. As shown in FIG. 9, the through-wiring 174 is electrically connected to the electrode 152 on the second surface 306. In addition, a bump electrode 142 is provided on the electrode 152. As shown in FIG. 6, the bump electrode 142 is electrically connected to the lower electrode layer 137 of the nozzle N2 forming the line L2, among the piezoelectric elements 60 provided on the vibration substrate 36. As a result, the drive signal VOUT is supplied to the piezoelectric element 60 via the electrode 152 and the bump electrode 142.

As shown in FIG. 10, the actuator substrate 35 includes the vibration substrate 36. On the vibration substrate 36, M number of sets of the lower electrode layer 137 and the piezoelectric layer 138 corresponding to the nozzle N1 forming the line L1, the lower electrode layer 137 and the piezoelectric layer 138 corresponding to the nozzle N2 forming the line L2, and the upper electrode layer 139 commonly provided on the lines L1 and L2, are formed along the Y direction corresponding to the M number of nozzles N1 forming the line L1. That is, as shown in FIGS. 8 and 9, in the interposer substrate 38, M number of electrodes are formed for each of the electrodes 151, 152, and 153, and M number of bump electrodes are formed for each of the bump electrodes 141, 142, and 143.

Thereby, the drive signal VOUT and the reference voltage signal VBS corresponding to each of the M number of piezoelectric elements 60 corresponding to the nozzle N1 forming the line L1, and M number of piezoelectric elements 60 corresponding to the nozzle N2 forming the line L2, are supplied.

Among the M number of electrodes 171 provided along the Y direction from the side 301 toward the side 302, the electrode 171-1 provided on a side closest to the side 301 is electrically connected to a wiring 340. The wiring 340 is formed along the Y direction from the side 301 side toward the side 302 side. The wiring 340 is electrically connected to the electrode 330 provided on the side 302 side of the electrode 171-M.

As shown in FIG. 6 and FIGS. 8 to 10, the electrode 171-1 is electrically connected to the drive IC 62. As a result, the drive signal VOUT is input to the electrode 171-1 from the drive IC 62. The drive signal VOUT input to the electrode 171-1 is supplied to the piezoelectric element 60-1 included in the line L1 via the through-wiring 173-1, the electrode 151-1, and the bump electrode 141-1. Therefore, the drive signal VOUT supplied to the piezoelectric element 60-1 included in the line L1, is supplied to the electrode 330 which is electrically connected to the electrode 171-1. The electrode 330 provided as described above functions as an inspection electrode for performing an inspection/confirmation of signal waveform of the drive signal VOUT supplied to the piezoelectric element 60-1 included in the line L1.

The piezoelectric element 60-1 included in the line L1 is an example of a first drive element, the drive signal VOUT supplied to the piezoelectric element 60-1 included in the line L1 is an example of a first signal, the electrode 171-1 to which the drive signal VOUT is input to the interposer substrate 38 is an example of a first electrode, and the electrode 330 electrically connected to the electrode 171-1 is an example of a third electrode.

Among the M number of electrodes 171, the electrode 171-M provided on a side closest to the side 302 and provided at the M-th position from the side 301, is electrically connected to the wiring 342. The wiring 342 is formed along the Y direction from the side 301 toward the side 302. The wiring 342 is electrically connected to the electrode 332 provided on the side 302 side of the electrode 330.

As shown in FIG. 6 and FIGS. 8 to 10, the electrode 171-M is electrically connected to the drive IC 62. As a result, the drive signal VOUT is input to the electrode 171-M from the drive IC 62. The drive signal VOUT input to the electrode 171-M is supplied to the piezoelectric element 60-M included in the line L1 via the through-wiring 173-M, the electrode 151-M, and the bump electrode 141-M. Therefore, the drive signal VOUT supplied to the piezoelectric element 60-M included in the line L1, is supplied to the electrode 332 which is electrically connected to the electrode 171-M. The electrode 332 provided as described above functions as an inspection electrode for performing an inspection/confirmation of signal waveform of the drive signal VOUT supplied to the piezoelectric element 60-M included in the line L1.

The piezoelectric element 60-M included in the line L1 is an example of a second drive element, the drive signal VOUT supplied to the piezoelectric element 60-M included in the line L1 is an example of a second signal, the electrode 171-M to which the drive signal VOUT is input to the interposer substrate 38 is an example of a second electrode, and the electrode 332 electrically connected to the electrode 171-M is an example of a fourth electrode.

Among the M number of electrodes 171, the electrode 171-*i* provided at the i-th (i is any one of 2 to M−1) position from the side 301, is electrically connected to the wiring 341. The wiring 341 is formed along the Y direction from the side 301 toward the side 302. The wiring 341 is electrically connected to the electrode 331 provided between the electrode 330 and the electrode 332.

As shown in FIG. 6 and FIGS. 8 to 10, the electrode 171-*i* is electrically connected to the drive IC 62. As a result, the drive signal VOUT is input to the electrode 171-*i* from the drive IC 62. The drive signal VOUT input to the electrode 171-*i* is supplied to the piezoelectric element 60-*i* included in the line L1 via the through-wiring 173-*i*, the electrode 151-*i*, and the bump electrode 141-*i*. Therefore, the drive signal VOUT supplied to the piezoelectric element 60-*i* included in the line L1, is supplied to the electrode 331 which is electrically connected to the electrode 171-*i*. The electrode 331 provided as described above functions as an inspection electrode for performing an inspection/confirmation of signal waveform of the drive signal VOUT supplied to the piezoelectric element 60-*i* included in the line L1.

The electrodes 171-1, 171-*i*, and 171-M, and the electrodes 330, 331, and 332 are provided in the order of the electrodes 171-1, 171-*i*, 171-M, 330, 331, and 332, in the direction from the side 301 toward the side 302. That is, in the Y direction along the side 303, the electrode 171-M is positioned between the electrode 171-1 and the electrode 331, and the electrode 331 is positioned between the electrode 171-M and the electrode 333. Thereby, it is possible to reduce variations in wiring length among the wiring 340 that electrically connectes the electrode 171-1 with the electrode 330, the wiring 341 that electrically connectes the electrode 171-*i* with the electrode 331, and the wiring 342 that electrically connectes the electrode 171-M with the electrode 332. Therefore, variations in the wiring resistance of the wirings 340, 341, and 342 are reduced, and variations occur in the signal waveform of the drive signal VOUT supplied to each of the electrodes 330, 331, and 332, due to the variations in the wiring resistance are reduced. Therefore, it is possible to improve the inspection accuracy of the drive signal VOUT supplied to the piezoelectric element 60.

Among the M number of electrodes 172 provided along the Y direction from the side 301 toward the side 302, the electrode 172-1 provided on a side closest to the side 301 is electrically connected to a wiring 349. The wiring 349 is formed along the Y direction from the side 301 toward the side 302. The wiring 349 is electrically connected to the electrode 339 provided on the side 302 side of the electrode 172-M.

As shown in FIG. 6 and FIGS. 8 to 10, the electrode 172-1 is electrically connected to the drive IC 62. As a result, the drive signal VOUT is input to the electrode 172-1 from the drive IC 62. The drive signal VOUT input to the electrode 172-1 is supplied to the piezoelectric element 60-1 included in the line L2 via the through-wiring 174-1, the electrode 152-1, and the bump electrode 142-1. Therefore, the drive signal VOUT supplied to the piezoelectric element 60-1 included in the line L2, is supplied to the electrode 339 which is electrically connected to the electrode 172-1. The electrode 339 provided as described above functions as an inspection electrode for performing an inspection/confirmation of signal waveform of the drive signal VOUT supplied to the piezoelectric element 60-1 included in the line L2.

The piezoelectric element 60-1 included in the line L2 is another example of the first drive element, the drive signal VOUT supplied to the piezoelectric element 60-1 included in the line L2 is another example of the first signal, the electrode 172-1 to which the drive signal VOUT is input to the interposer substrate 38 is another example of the first electrode, and the electrode 339 electrically connected to the electrode 172-1 is another example of the third electrode.

Among the M number of electrodes 172, the electrode 172-M provided on a side closest to the side 302 and provided at the M-th position from the side 301, is electrically connected to the wiring 347. The wiring 347 is formed along the Y direction from the side 301 toward the side 302. The wiring 347 is electrically connected to the electrode 337 provided on the side 302 side of the electrode 339.

As shown in FIG. 6 and FIGS. 8 to 10, the electrode 172-M is electrically connected to the drive IC 62. As a result, the drive signal VOUT is input to the electrode 172-M from the drive IC 62. The drive signal VOUT input to the electrode 172-M is supplied to the piezoelectric element 60-M included in the line L2 via the through-wiring 174-M, the electrode 152-M, and the bump electrode 142-M. Therefore, the drive signal VOUT supplied to the piezoelectric element 60-M included in the line L2, is supplied to the electrode 337 which is electrically connected to the electrode 172-M. The electrode 337 provided as described above functions as an inspection electrode for performing an inspection/confirmation of signal waveform of the drive signal VOUT supplied to the piezoelectric element 60-M included in the line L2.

The piezoelectric element 60-M included in the line L2 is another example of the second drive element, the drive signal VOUT supplied to the piezoelectric element 60-M included in the line L2 is another example of the second signal, the electrode 172-M to which the drive signal VOUT is input to the interposer substrate 38 is another example of the second electrode, and the electrode 337 electrically connected to the electrode 172-M is another example of the fourth electrode.

Among the M number of electrodes 172, the electrode 172-*i* provided at the i-th (i is any one of 2 to M−1) position from the side 301, is electrically connected to the wiring 348. The wiring 348 is formed along the Y direction from the side 301 toward the side 302. The wiring 348 is electrically connected to the electrode 338 provided between the electrode 337 and the electrode 339.

As shown in FIG. 6 and FIGS. 8 to 10, the electrode 172-*i* is electrically connected to the drive IC 62. As a result, the drive signal VOUT is input to the electrode 172-*i* from the drive IC 62. The drive signal VOUT input to the electrode 172-*i* is supplied to the piezoelectric element 60-*i* included in the line L2 via the through-wiring 174-*i*, the electrode 152-*i*, and the bump electrode 142-*i*. Therefore, the drive signal VOUT supplied to the piezoelectric element 60-*i* included in the line L2, is supplied to the electrode 338 which is electrically connected to the electrode 172-*i*. The electrode 338 provided as described above functions as an inspection electrode for performing an inspection/confirmation of signal waveform of the drive signal VOUT supplied to the piezoelectric element 60-*i*.

The electrodes 172-1, 172-*i*, and 172-M, and the electrodes 337, 338, and 339 are provided in the order of the electrodes 172-1, 172-*i*, 172-M, 339, 338, and 337, in the direction from the side 301 toward the side 302. That is, in the Y direction along the side 303, the electrode 172-M is positioned between the electrode 172-1 and the electrode 339, and the electrode 339 is positioned between the electrode 172-M and the electrode 337. Thereby, it is possible to reduce variations in wiring length among the wiring 349 that electrically connectes the electrode 172-1 with the electrode 339, the wiring 348 that electrically connectes the electrode 172-*i* with the electrode 338, and the wiring 347 that electrically connectes the electrode 172-M with the electrode 337. Therefore, it is possible to reduce occurrence of variations in the signal waveform of the drive signal VOUT supplied to each of the electrodes 337, 338, and 339 due to variations in wiring resistance of the wirings 347, 348, and 349. Therefore, it is possible to improve the inspection accuracy of the drive signal VOUT supplied to the piezoelectric element 60.

The electrode 333 is electrically connected to the wiring 310 that propagates the drive signal COMA input from the connection wiring 64 via the electrode 380 and outputs the drive signal COMA to the drive IC 62 via the electrode 190, via a wiring 343. Specifically, the wiring 343 is electrically connected to the side 302 side of the wiring 310. The wiring 343 is formed along the Y direction from the side 301 toward the side 302.

The electrode 333 is positioned on the side 302 side of the wiring 310. Further, the electrode 333 is provided closer to the side 304 than the electrodes 330, 331, and 332 provided along the side 303, and provided closer to the side 303 than the electrodes 337, 338, and 339 provided along the side 304. In other words, a distance between the electrode 333 and the side 303 is longer than a distance between the electrode 330 and the side 303, and a distance between the electrode 333 and the side 304 is longer than a distance between the electrode 339 and the side 304.

The electrode 334 is electrically connected to the wiring 311 that propagates the drive signal COMB input from the connection wiring 64 via the electrode 381 and outputs the drive signal COMB to the drive IC 62 via the electrode 191, via a wiring 344. Specifically, the wiring 344 is electrically connected to the side 302 side of the wiring 311. The wiring 344 is formed along the Y direction from the side 301 toward the side 302.

The electrode 334 is positioned on the side 302 side of the wiring 310. Further, the electrode 334 is provided closer to the side 304 than the electrodes 330, 331, and 332 provided along the side 303, and provided closer to the side 303 than the electrodes 337, 338, and 339 provided along the side 304. In other words, a distance between the electrode 334 and the side 303 is longer than a distance between the electrode 330 and the side 303, and a distance between the electrode 334 and the side 304 is longer than a distance between the electrode 339 and the side 304.

The electrode 335 is electrically connected to the wiring 318 that propagates the drive signal COMB input from the connection wiring 64 via the electrode 388 and outputs the drive signal COMB to the drive IC 62 via the electrode 198, via a wiring 345. Specifically, the wiring 345 is electrically connected to the side 302 side of the wiring 318. The wiring 345 is formed along the Y direction from the side 301 toward the side 302.

The electrode 335 is positioned on the side 302 side of the wiring 318. Further, the electrode 335 is provided closer to the side 304 than the electrodes 330, 331, and 332 provided along the side 303, and provided closer to the side 303 than the electrodes 337, 338, and 339 provided along the side 304. In other words, a distance between the electrode 335 and the side 303 is longer than a distance between the electrode 330 and the side 303, and a distance between the electrode 335 and the side 304 is longer than a distance between the electrode 339 and the side 304.

The electrode 336 is electrically connected to the wiring 319 that propagates the drive signal COMA input from the connection wiring 64 via the electrode 389 and outputs the drive signal COMA to the drive IC 62 via the electrode 199, via a wiring 346. Specifically, the wiring 346 is electrically connected to the side 302 side of the wiring 319. The wiring 346 is formed along the Y direction from the side 301 toward the side 302.

The electrode 336 is positioned on the side 302 side of the wiring 319. Further, the electrode 336 is provided closer to the side 304 than the electrodes 330, 331, and 332 provided along the side 303, and provided closer to the side 303 than the electrodes 337, 338, and 339 provided along the side 304. In other words, a distance between the electrode 336 and the side 303 is longer than a distance between the electrode 330 and the side 303, and a distance between the electrode 336 and the side 304 is longer than a distance between the electrode 339 and the side 304.

The electrodes 333 to 336 provided as described above function as inspection electrodes for performing inspections/confirmations of signal waveforms of the drive signals COMA and COMB input to the drive ICs 62 before being input to the drive ICs 62. When an abnormality such as a distortion occurs in the signal waveform of the drive signal VOUT, it is possible to inspect whether or not the distortion is caused by the drive ICs 62 by inspecting/confirming the signal waveforms of the drive signals COMA and COMB as the basis of the drive signal VOUT before being input to the drive ICs 62. Therefore, it is possible to take countermeasures to reduce the distortion occurred in the signal waveform of the drive signal VOUT based on the inspection result, accordingly, it is possible to improve the inspection accuracy of the drive signal VOUT supplied to the piezoelectric element 60.

One of the drive signals COMA and COMB as the basis of the drive signal VOUT is an example of a third signal, one of the electrodes 190, 191, 198, and 199 is an example of a fifth electrode, and one of the electrodes 333 to 336 is an example of a sixth electrode.

The electrodes 330 to 339 provided as described above may be provided at positions not overlapping the drive ICs 62 mounted on the interposer substrate 38, when the interposer substrate 38 is viewed from the first surface 305 in a plan view. It is possible to easily inspect/confirm the signal waveform of the drive signal VOUT by providing the electrodes 330 to 339 at positions not overlapping with the drive ICs 62.

In the above description, the electrode 171 electrically connected to the wiring 340 is described as an electrode 171-1 provided on a side closest to the side 301 of the interposer substrate 38, and the electrode 171 electrically connected to the wiring 342 is described as an electrode 171-M provided on a side closest to the side 302 of the interposer substrate 38, but the embodiment is not limited thereto. For example, the electrode 171 electrically connected to the wiring 340 may be set the j-th electrode 171-*j* from the side 301 and the electrode 171 electrically connected to the wiring 342 may be set the k-th electrode 171-*k* from the side 301, and in this case, it suffices that the relationship of $1 \leq j < k \leq M$ is satisfied.

2 Second Embodiment

Next, a liquid discharge apparatus 1 of a second embodiment, a liquid discharge head 21 and an actuator substrate 35 which is a wiring substrate will be described. In describing the liquid discharge apparatus 1 of the second embodiment, the same reference numerals are given to the same configurations as those of the first embodiment, and the description thereof will be omitted. The liquid discharge head 21 according to the second embodiment is different from the first embodiment in that an inspection electrode for confirming the signal waveform of the drive signal VOUT is provided on the vibration substrate 36. That is, in the liquid discharge head 21 according to the second embodiment, an actuator substrate 35 including the vibration substrate 36 and a plurality of detection electrodes also provided on the vibration substrate 36 is another example of the wiring substrate.

Figure 11:
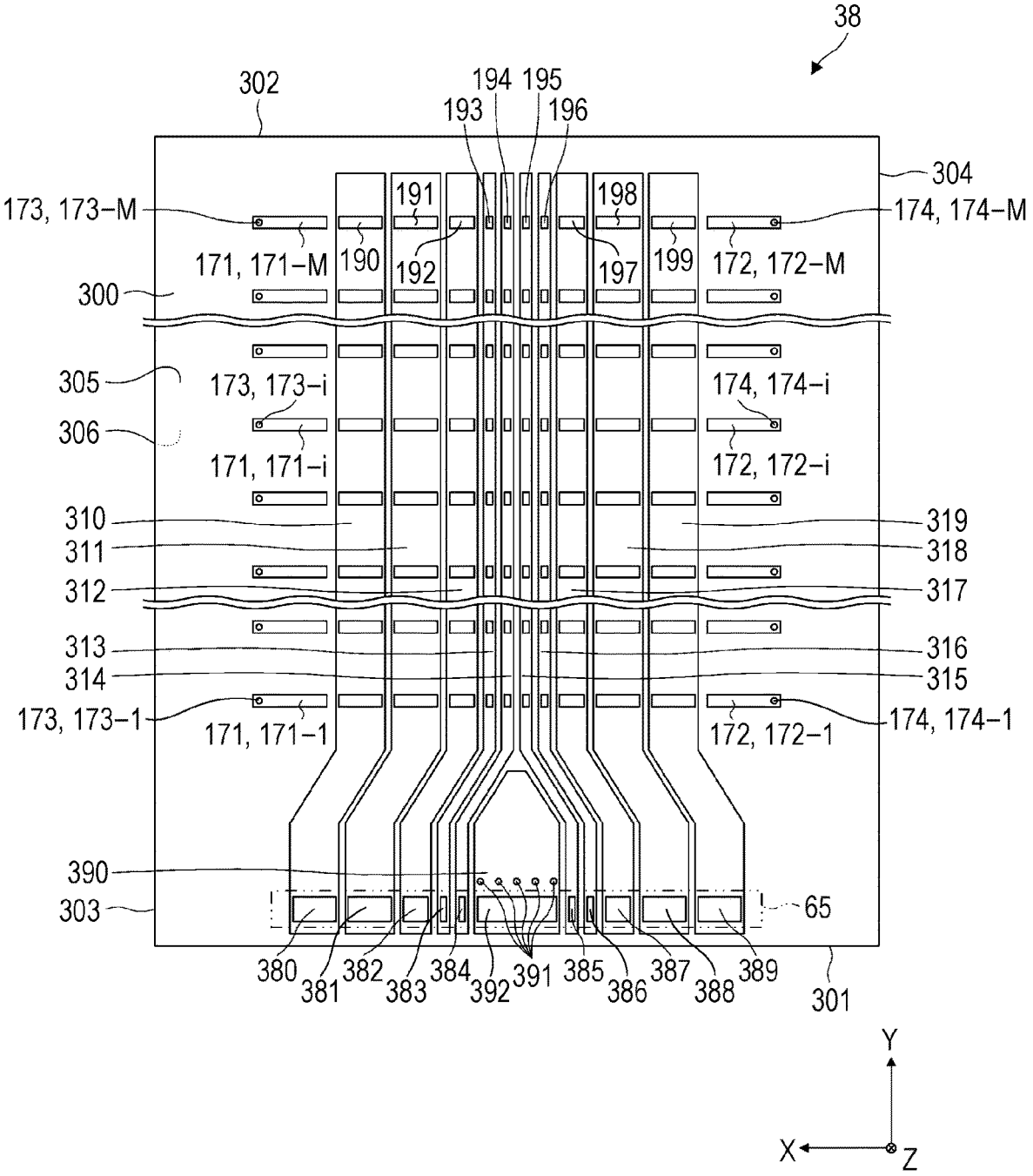
FIG. 11 is a plan view showing a configuration when an interposer substrate of a second embodiment is viewed from the surface.
Figure 12:
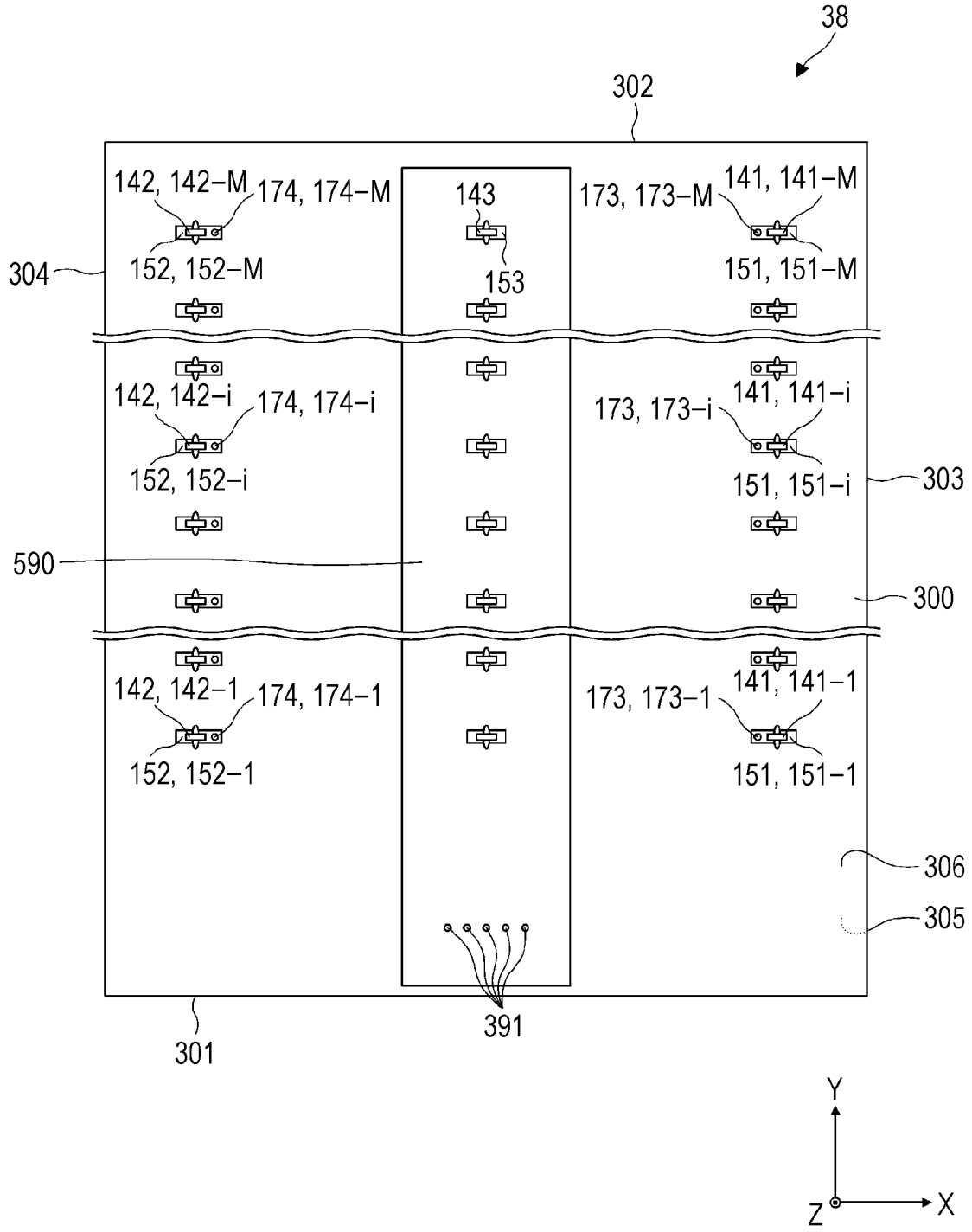
FIG. 12 is a plan view showing a configuration when the interposer substrate of the second embodiment is viewed from the surface.
Figure 13:
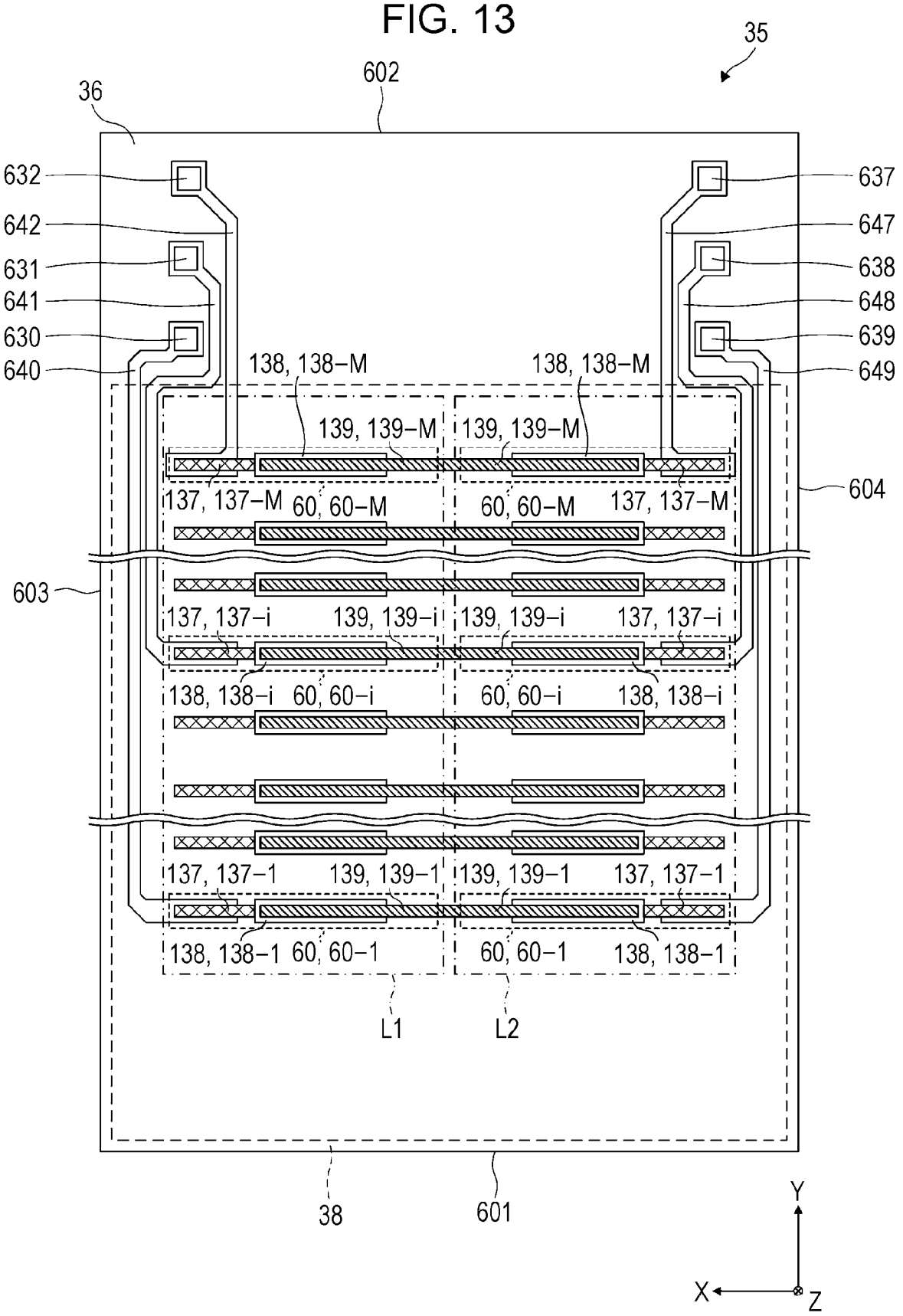
FIG. 13 is a plan view showing a surface on the interposer substrate side of the actuator substrate of the second embodiment, and on which the piezoelectric elements are formed.

Configurations of the interposer substrate 38 and the actuator substrate 35 according to the second embodiment will be described with reference to FIGS. 11 to 13. FIG. 11 is a plan view showing a configuration when the interposer substrate 38 is viewed from the surface G2. In FIG. 11, the drive ICs 62 mounted on the interposer substrate 38 are indicated by one-dot chain lines. FIG. 12 is a plan view showing a configuration when the interposer substrate 38 is viewed from the surface G1. FIG. 13 is a plan view showing a surface which is on the interposer substrate 38 side of the actuator substrate 35, and on which piezoelectric elements 60 are formed. In FIG. 13, the interposer substrate 38 electrically connected to the actuator substrate 35 is indicated by a dashed line.

As shown in FIG. 13, the actuator substrate 35 includes a vibration substrate 36, a plurality of piezoelectric elements 60, and a plurality of inspection electrodes. The vibration substrate 36 has a substantially rectangular shape formed by a side 601, a side 602 facing the side 601, a side 603 longer than the side 601, and a side 604 facing the side 603. Here, the side 601 or the side 602 is an example of a first side, and the side 603 or the side 604 is an example of a second side.

As shown in FIG. 11, drive signals COMA and COMB, a printing data signal SI, a change signal CH, a latch signal LAT, and a clock signal SCK are input to the interposer substrate 38 via electrodes 380 to 389 and 392. Then, the input various signals are input to the drive IC 62 via the electrodes 190 to 199. The drive IC 62 outputs a plurality of drive signals VOUT corresponding to each of the M number of piezoelectric elements 60 included in the line L1 and the M number of piezoelectric elements 60 included in the line L2 based on the various signals input thereto.

As shown in FIGS. 11 to 13, the drive signal VOUT output from the drive IC 62 is supplied to the lower electrode layers 137-1 to 137-M included in the piezoelectric elements 60-1 to 60-M formed on the vibration substrate 36, via the electrodes 171-1 to 171-M, the through-wirings 173-1 to 173-M, the electrodes 151-1 to 151-M, and the bump electrodes 141-1 to 141-M, which are provided on the interposer substrate 38. Each of the piezoelectric elements 60-1 to 60-M is driven based on the input drive signal VOUT.

As shown in FIG. 13, among the M number of piezoelectric elements 60 included in the line L1 provided along the Y direction from the side 601 toward the side 602 in the vibration substrate 36, the lower electrode layer 137-1 included in the piezoelectric element 60-1 provided on a side closest to the side 601 is electrically connected to a wiring 640. The wiring 640 is formed along the Y direction from the side 601 toward the side 602. The wiring 640 is electrically connected to the electrode 630 provided on the side 602 side of the line L1.

As described above, the drive signal VOUT supplied to the piezoelectric element 60-1 included in the line L1, is supplied to the lower electrode layer 137-1. Therefore, the drive signal VOUT supplied to the piezoelectric element 60-1 included in the line L1, is supplied to the electrode 630 which is electrically connected to the lower electrode layer 137-1. The electrode 630 provided as described above functions as an inspection electrode for performing an inspection/confirmation of signal waveform of the drive signal VOUT supplied to the piezoelectric element 60-1 included in the line L1.

The piezoelectric element 60-1 included in the line L1 is an example of a first drive element in the second embodiment, the drive signal VOUT supplied to the piezoelectric element 60-1 included in the line L1 is an example of a first signal in the second embodiment, the lower electrode layer 137-1 to which the drive signal VOUT is input to the vibration substrate 36 is an example of a first electrode, and the electrode 630 electrically connected to the lower electrode layer 137-1 is an example of a third electrode.

Among the M number of piezoelectric elements 60 included in the line L1, the lower electrode layer 137-M included in the piezoelectric element 60-M provided on a side closest to the side 602 and provided at the M-th position from the side 601, is electrically connected to the wiring 642. The wiring 642 is formed along the Y direction from the side 601 toward the side 602. The wiring 642 is electrically connected to the electrode 632 provided on the side 602 side of the electrode 630.

As described above, the drive signal VOUT supplied to the piezoelectric element 60-M included in the line L1, is supplied to the lower electrode layer 137-M. Therefore, the drive signal VOUT supplied to the piezoelectric element 60-M included in the line L1, is supplied to the electrode 632 which is electrically connected to the lower electrode layer 137-M. The electrode 632 provided as described above functions as an inspection electrode for performing an inspection/confirmation of signal waveform of the drive signal VOUT supplied to the piezoelectric element 60-M included in the line L1.

The piezoelectric element 60-M included in the line L1 is an example of a second drive element in the second embodiment, the drive signal VOUT supplied to the piezoelectric element 60-M included in the line L1 is an example of a second signal in the second embodiment, the lower electrode layer 137-M to which the drive signal VOUT is input to the vibration substrate 36 is an example of a second electrode, and the electrode 632 electrically connected to the lower electrode layer 137-M is an example of a fourth electrode.

Among the M number of piezoelectric elements 60 included in line L1, the lower electrode layer 137-*i* provided at the i-th (i is any one of 2 to M−1) position from the side 601, is electrically connected to the wiring 641. The wiring 641 is formed along the Y direction from the side 601 toward the side 602. The wiring 641 is electrically connected to the electrode 631 provided between the electrode 630 and the electrode 632.

As described above, the drive signal VOUT supplied to the piezoelectric element 60-*i* included in the line L1, is supplied to the lower electrode layer 137-*i*. Therefore, the drive signal VOUT supplied to the piezoelectric element 60-*i* included in the line L1, is supplied to the electrode 631 which is electrically connected to the lower electrode layer 137-*i*. The electrode 631 provided as described above functions as an inspection electrode for performing an inspection/confirmation of signal waveform of the drive signal VOUT supplied to the piezoelectric element 60-*i* included in the line L1.

Among the M number of piezoelectric elements 60 included in the line L2 provided along the Y direction from the side 601 toward the side 602 in the vibration substrate 36, the lower electrode layer 137-1 included in the piezoelectric element 60-1 provided on a side closest to the side 601 is electrically connected to a wiring 649. The wiring 649 is formed along the Y direction from the side 601 toward the side 602. The wiring 649 is electrically connected to the electrode 639 provided on the side 602 side of the line L1.

As described above, the drive signal VOUT supplied to the piezoelectric element 60-1 included in the line L2, is supplied to the lower electrode layer 137-1. Therefore, the drive signal VOUT supplied to the piezoelectric element 60-1 included in the line L2, is supplied to the electrode 639 which is electrically connected to the lower electrode layer 137-1. The electrode 639 provided as described above functions as an inspection electrode for performing an inspection/confirmation of signal waveform of the drive signal VOUT supplied to the piezoelectric element 60-1 included in the line L2.

The piezoelectric element 60-1 included in the line L2 is another example of the first drive element in the second embodiment, the drive signal VOUT supplied to the piezoelectric element 60-1 included in the line L2 is another example of the first signal in the second embodiment, the lower electrode layer 137-1 to which the drive signal VOUT is input to the vibration substrate 36 is another example of the first electrode, and the electrode 639 electrically connected to the lower electrode layer 137-1 is another example of the third electrode.

Among the M number of piezoelectric elements 60 included in the line L2, the lower electrode layer 137-M included in the piezoelectric element 60-M provided on a side closest to the side 602 and provided at the M-th position from the side 601, is electrically connected to the wiring 647. The wiring 647 is formed along the Y direction from the side 601 toward the side 602. The wiring 647 is electrically connected to the electrode 637 provided on the side 602 side of the electrode 630.

As described above, the drive signal VOUT supplied to the piezoelectric element 60-M included in the line L2, is supplied to the lower electrode layer 137-M. Therefore, the drive signal VOUT supplied to the piezoelectric element 60-M included in the line L1, is supplied to the electrode 637 which is electrically connected to the lower electrode layer 137-M. The electrode 637 provided as described above functions as an inspection electrode for performing an inspection/confirmation of signal waveform of the drive signal VOUT supplied to the piezoelectric element 60-M included in the line L1.

The piezoelectric element 60-M included in the line L2 is another example of the second drive element in the second embodiment, the drive signal VOUT supplied to the piezoelectric element 60-M included in the line L2 is another example of the second signal in the second embodiment, the lower electrode layer 137-M to which the drive signal VOUT is input to the vibration substrate 36 is another example of the second electrode, and the electrode 637 electrically connected to the lower electrode layer 137-M is another example of the fourth electrode.

Among the M number of piezoelectric elements 60 included in line L2, the lower electrode layer 137-*i* provided at the i-th (i is any one of 2 to M−1) position from the side 601, is electrically connected to the wiring 648. The wiring 648 is formed along the Y direction from the side 601 toward the side 602. The wiring 648 is electrically connected to the electrode 638 provided between the electrode 639 and the electrode 637.

As described above, the drive signal VOUT supplied to the piezoelectric element 60-*i* included in the line L2, is supplied to the lower electrode layer 137-*i*. Therefore, the drive signal VOUT supplied to the piezoelectric element 60-*i* included in the line L2, is supplied to the electrode 638 which is electrically connected to the lower electrode layer 137-*i*. The electrode 638 provided as described above functions as an inspection electrode for performing an inspection/confirmation of signal waveform of the drive signal VOUT supplied to the piezoelectric element 60-*i* included in the line L2.

As described above, the lower electrode layers 137-1, 137-*i*, and 137-M and the electrodes 630, 631, and 632 included in the piezoelectric element 60-*i* included in the line L1, are arranged in the order of the lower electrode layers 137-1, 137-*i*, and 137-M, and the electrodes 630, 631, and 632, in a direction from the side 601 toward the side 602. Thereby, it is possible to reduce variations in wiring length among the wiring 640 that electrically connectes the lower electrode layer 137-1 with the electrode 630, the wiring 641 that electrically connectes the lower electrode layer 137-*i* with the electrode 631, and the wiring 642 that electrically connectes the lower electrode layer 137-M with the electrode 632. Therefore, as in the first embodiment, variations in the wiring resistance of the wirings 640, 641, and 642 are reduced, and variations occur in the signal waveform of the drive signal VOUT supplied to each of the electrodes 630, 631, and 632, due to the variations in the wiring resistance, are reduced. Therefore, as in the first embodiment, it is possible to improve the inspection accuracy of the drive signal VOUT supplied to the plurality of piezoelectric elements 60.

Similarly, the lower electrode layers 137-1, 137-*i*, and 137-M and the electrodes 637, 638, and 639 included in the piezoelectric element 60-*i* included in the line L2, are arranged in the order of the lower electrode layers 137-1, 137-*i*, and 137-M, and the electrodes 639, 638, and 637, in a direction from the side 601 toward the side 602. Thereby, it is possible to reduce variations in wiring length among the wiring 649 that electrically connectes the lower electrode layer 137-1 with the electrode 639, the wiring 648 that electrically connectes the lower electrode layer 137-*i* with the electrode 638, and the wiring 647 that electrically connectes the lower electrode layer 137-M with the electrode 637. Therefore, as in the first embodiment, variations in the wiring resistance of the wirings 647, 648, and 649 are reduced, and variations occur in the signal waveform of the drive signal VOUT supplied to each of the electrodes 637, 638, and 639, due to the variations in the wiring resistance, are reduced. Therefore, as in the first embodiment, it is possible to improve the inspection accuracy of the drive signal VOUT supplied to the plurality of piezoelectric elements 60.

In addition, the electrodes 630 to 632 and 637 to 639 provided as described above may be provided at positions not overlapping with the interposer substrate 38 mounted on the vibration substrate 36 when the vibration substrate 36 is viewed in a plan view. It is possible to easily inspect/confirm the signal waveform of the drive signal VOUT by providing the electrodes 630 to 632, 637 to 639 and the interposer substrate 38 at positions not overlapping with each other.

What is claimed is:

1. A liquid discharge head comprising:

a first drive element driven by a first signal supplied thereto;

a second drive element driven by a second signal supplied thereto;

a drive IC that outputs the first signal and the second signal, and is configured to receive as an input a third signal that is a base of the first signal and the second signal; and a wiring substrate having a first side and a second side that is longer than the first side, electrically connected to the drive IC, and propagating the first signal and the second signal, wherein the wiring substrate includes a first electrode to which the first signal is input, a second electrode to which the second signal is input, a third electrode electrically connected to the first electrode, a fourth electrode electrically connected to the second electrode, a fifth electrode that outputs the third signal to the drive IC, and a sixth electrode electrically connected to the fifth electrode, in a direction along the second side, the second electrode is positioned between the first electrode and the third electrode, and the third electrode is positioned between the second electrode and the fourth electrode, and a distance between the sixth electrode and the second side is longer than a distance between the first electrode and the second side.

2. The liquid discharge head according to claim 1, wherein a plurality of nozzles including a nozzle that discharges liquid by driving the first drive element are arranged in the direction along the second side, and the first electrode, the second electrode, the third electrode, and the fourth electrode are arranged in the direction along the second side.

3. The liquid discharge head according to claim 1, wherein the third electrode and the fourth electrode are provided at positions not overlapping with the drive IC in a plan view of the wiring substrate.

4. A liquid discharge apparatus comprising:

the liquid discharge head according to claim 1; and a control circuit that controls the liquid discharge head.

5. A liquid discharge head comprising:

a first drive element driven by a first signal supplied thereto;

a second drive element driven by a second signal supplied thereto;

a drive IC that outputs the first signal and the second signal; and a wiring substrate having a first side and a second side that is longer than the first side, electrically connected to the drive IC, and propagating the first signal and the second signal, wherein the wiring substrate includes a first electrode to which the first signal is input, a second electrode to which the second signal is input, a third electrode electrically connected to the first electrode, and a fourth electrode electrically connected to the second electrode, and in a direction along the second side, the second electrode is positioned between the first electrode and the third electrode, and the third electrode is positioned between the second electrode and the fourth electrode, and wherein a direction that is parallel to a direction in which the first side extends is defined as a first direction, and a position of the first electrode in the first direction relative to the second side, a position of the second electrode in the first direction relative to the second side, a position of the third electrode in the first direction relative to the second side, and a position of the fourth electrode in the first direction relative to the second side is the same.

6. The liquid discharge head according to claim 5, wherein a plurality of nozzles including a nozzle that discharges liquid by driving the first drive element are arranged in the direction along the second side, and the first electrode, the second electrode, the third electrode, and the fourth electrode are arranged in the direction along the second side.

7. The liquid discharge head according to claim 5, wherein the third electrode and the fourth electrode are provided at positions not overlapping with the drive IC in a plan view of the wiring substrate.

8. The liquid discharge head according to claim 5, wherein a third signal that is a base of the first signal and the second signal is input to the drive IC, the wiring substrate includes a fifth electrode that outputs the third signal to the drive IC, and a sixth electrode electrically connected to the fifth electrode, and a distance between the sixth electrode and the second side is longer than a distance between the first electrode and the second side.

9. A liquid discharge apparatus comprising:

the liquid discharge head according to claim 5; and a control circuit that controls the liquid discharge head.

* * * * *